US011057696B2

(12) United States Patent
Mordechai

(10) Patent No.: US 11,057,696 B2
(45) Date of Patent: Jul. 6, 2021

(54) LOW PROFILE DUAL DRIVER MAGNET

(71) Applicant: Oren Mordechai, Ramat Hasharon (IL)

(72) Inventor: Oren Mordechai, Ramat Hasharon (IL)

( * ) Notice: Subject to any disclaimer, the term of this patent is extended or adjusted under 35 U.S.C. 154(b) by 0 days.

(21) Appl. No.: 16/647,514

(22) PCT Filed: Sep. 6, 2018

(86) PCT No.: PCT/IL2018/051009
§ 371 (c)(1),
(2) Date: Mar. 15, 2020

(87) PCT Pub. No.: WO2019/053714
PCT Pub. Date: Mar. 21, 2019

(65) Prior Publication Data

US 2020/0221214 A1 Jul. 9, 2020

Related U.S. Application Data

(60) Provisional application No. 62/559,567, filed on Sep. 17, 2017.

(51) Int. Cl.

| | |
|---|---|
| ***H04R 1/24*** | (2006.01) |
| ***H04R 7/12*** | (2006.01) |
| ***H04R 7/18*** | (2006.01) |
| ***H04R 9/02*** | (2006.01) |
| ***H04R 9/04*** | (2006.01) |
| ***H04R 9/06*** | (2006.01) |

(52) U.S. Cl.
CPC ..... *H04R 1/24* (2013.01); *H04R 7/12* (2013.01); *H04R 7/18* (2013.01); *H04R 9/025* (2013.01); *H04R 9/043* (2013.01); *H04R 9/06* (2013.01); *H04R 2400/11* (2013.01)

(58) Field of Classification Search
CPC ... H04R 1/24; H04R 7/12; H04R 7/18; H04R 9/025; H04R 9/043; H04R 9/06; H04R 2400/11
See application file for complete search history.

(56) References Cited

U.S. PATENT DOCUMENTS

| | | | |
|---|---|---|---|
| 6,963,651 | B2 | 11/2005 | Peng |
| 7,433,485 | B1 | 10/2008 | Diedrich |
| 8,175,320 | B2 | 5/2012 | Lin |
| 8,831,270 | B1 | 9/2014 | Dimitrov |
| 9,467,783 | B2 | 10/2016 | Bullimore |
| 2010/0046783 | A1 | 2/2010 | Huang |

(Continued)

FOREIGN PATENT DOCUMENTS

| | | | |
|---|---|---|---|
| CN | 204157049 | U | 2/2015 |
| DE | 3001873 | A1 | 7/1981 |

OTHER PUBLICATIONS

International Search Report of PCT/IL2018/051009 Completed Jan. 3, 2019; dated Jan. 3, 2019 3 pages.

(Continued)

*Primary Examiner* — Andrew L Sniezek
(74) *Attorney, Agent, or Firm* — The Roy Gross Law Firm, LLC; Roy Gross

(57) ABSTRACT

The disclosed technology relates to speaker drivers and micro-drivers, and more particularly to speaker drivers that include a woofer and a tweeter driven by a first and a second magnetic circuit, respectively, both magnetic circuits sharing a single magnet.

16 Claims, 19 Drawing Sheets

(56) References Cited

U.S. PATENT DOCUMENTS

| | | | | |
|---|---|---|---|---|
| 2013/0170675 | A1 | 7/2013 | Saint Vincent | |
| 2014/0056436 | A1 | 2/2014 | Kim | |
| 2014/0169583 | A1 | 6/2014 | Huang | |
| 2014/0286524 | A1* | 9/2014 | Robineau | H04R 1/24 381/412 |
| 2015/0373436 | A1 | 12/2015 | Chu | |

OTHER PUBLICATIONS

Written Opinion of PCT/IL2018/051009 Completed Jan. 3, 2019; dated Jan. 3, 2019 4 pages.

* cited by examiner

LOW PROFILE DUAL DRIVER MAGNET

CROSS REFERENCE TO RELATED APPLICATIONS

This application is a National Phase of PCT Patent Application No. PCT/IL2018/051009 having International filing date of Sep. 6, 2018, which claims the benefit of priority of U.S. Provisional Application No. 62/559,567 filed on Sep. 17, 2017. The contents of the above applications are all incorporated by reference as if fully set forth herein in their entirety.

FIELD OF THE INVENTION

The disclosed technology relates to speaker drivers and micro-drivers, and more particularly to loudspeaker or headphone drivers that include a woofer and a tweeter driven by a first and a second magnetic circuit, respectively, both magnetic circuits sharing a single magnet.

BACKGROUND OF THE INVENTION

Speaker drivers and micro-drivers are electro-acoustic converters, which accept electric signals and transduce them into soundwaves. A conventional speaker driver has a magnetic circuit provided in a frame or chassis, covered by a diaphragm. The magnetic circuit usually includes a permanent magnet and magnetically permeable components, such as a yoke and top or bottom plates, so that the magnetic field is directed from the north pole of the magnet, through the magnetic permeable components, back to the south pole of the magnet. A voice coil is movably disposed within a gap in the magnetic circuit, wherein the edge of the voice coil is attached to the diaphragm. As electric current is fed to the voice coil, according to Fleming's left-hand rule, another magnetic field is created, vibrating the voice coil either in the same direction or opposed to the magnetic field generated by the magnetic circuit. Accompanying this, the diaphragm connected to the voice coil is driven to reproduce sound.

A single driver with one diaphragm is not suitable for providing full performance over the whole audible frequency range. Generally, a speaker, which includes more than one driver, or a system of more than one speaker, each including a single driver, should be provided in order to cover both high- and low-range frequencies. Coaxial speakers, including both a woofer covering low-frequency range, and a tweeter covering high-frequency range, are known in the art. However, known coaxial speakers utilize separate magnetic circuits with more than one magnet, each magnet separately dedicated to a different magnetic circuit.

There is an unmet need for a unified driver, including both a woofer and a tweeter, utilizing a smaller amount of components in order to reduce the required space and thus the size of the speaker, without compromising sound quality.

SUMMARY OF THE INVENTION

Aspects of the disclosed technology, according to some embodiments thereof, relate to speaker drivers. More specifically, aspects of the disclosed technology, according to some embodiments thereof, relate to speaker drivers that include a woofer and a tweeter driven by a first and a second magnetic circuit, respectively, both magnetic circuits sharing a single magnet.

Moreover, both the first and the second magnetic circuits share additional magnetically permeable components, such as a single top plate, a yoke and an optional cup. In order to focus the magnetic flux passing through each magnetic circuit, the top plate includes a geometrical separating feature, which separates between a first plate portion and a second plate portion. The first magnetic circuit includes a first gap and the second magnetic circuit includes a second gap, both first and second gaps are parallel, radially surrounding the outer and inner edges of the magnet, respectively. A woofer voice coil, having a woofer voice coil wire, is disposed within the first gap, and a tweeter voice coil, having a tweeter voice coil wire, is disposed within the second gap. The middle point along the vertical length of the woofer voice coil wire and the middle point along the vertical length of the tweeter voice coil wire are horizontally aligned, thus offering improved time alignment between the woofer and the tweeter.

Advantageously, driving both a woofer and a tweeter by two magnetic circuits that share similar components would reduce costs, increase magnet efficiency, as well as easing assembly complexity during manufacturing process.

Another advantage of the disclosed technology is placement of the radial location of the geometrical separating feature is optionally done according to the desired split between the intensity of the magnetic flux of the first and the second magnetic circuits. The simple coaxial arrangement of the speaker driver, according to the disclosed technology, along with the advantage of time alignment between the woofer and the tweeter, can be utilized not only for loudspeakers but also for headphones and micro-drivers.

According to some embodiments, there is provided a speaker driver comprising a magnet having a magnet top portion, a magnet bottom portion, a magnet outer circumference and a magnet inner circumference. The speaker driver further comprises a woofer voice coil disposed around the magnet outer circumference, a tweeter voice coil disposed around the magnet inner circumference, and a top plate adjacent on a horizontal plane to the magnet. The top plate having a first plate portion and a second plate portion, separated by a geometrical separating feature, wherein the magnet is configured to generate a first magnetic flux passing through the first plate portion and the woofer voice coil and a second magnetic flux passing through the second plate portion and the tweeter voice coil. Wherein the location of the geometrical separating feature along the top plate is configured to influence the intensity of each of the first magnetic flux and the second magnetic flux.

According to some embodiments, the woofer voice coil comprises a woofer former and a woofer voice coil wire wound around the woofer former. Further, the tweeter voice coil comprises a tweeter former and a tweeter voice coil wire wound around the tweeter former, wherein the middle point along the vertical length of the woofer voice coil wire and the middle point along the vertical length of the tweeter voice coil wire are substantially in the same horizontal plane.

According to some embodiments, the separating geometrical feature is a circumferential recess.

According to some embodiments, the separating geometrical feature is located radially at the center of the top plate.

According to some embodiments, the geometrical separating feature is located radially closer to the magnet inner circumference than to the magnet outer circumference.

According to some embodiments, the magnet comprises neodymium.

According to some embodiments, the geometrical separating feature is protruding throughout the complete vertical height of the top plate, thereby spacing apart the first plate portion and the second plate portion.

According to some embodiments, the speaker driver further comprises a woofer diaphragm with a woofer surround, the woofer diaphragm connected to a chassis having a chassis rim, and a tweeter diaphragm with a tweeter surround. The tweeter diaphragm connected to a tweeter alignment component placed on top of the top plate, wherein the woofer former is attached to the woofer diaphragm and the tweeter former is attached to the tweeter diaphragm. Also, wherein the top plate comprises at least one plate recess, and wherein the tweeter alignment component further comprises at least one alignment protrusion, configured to be accepted within the at least one plate recess, thereby aligning the tweeter alignment component and the top plate.

According to some embodiments, the speaker driver further comprises a chassis having a chassis base, a cup having a cup base and a cup sidewall (wherein the cup base is disposed on the chassis base and the woofer voice coil is disposed within a first gap, formed between the cup sidewall and the magnet outer circumference), and a yoke having a bottom yoke and a center pole (wherein the bottom yoke is disposed on the cup base and the tweeter voice coil is disposed within a second gap, formed between the center pole and the magnet inner circumference). Wherein the first magnetic flux runs from the magnet to the first plate portion, the first gap passing through the woofer voice coil, the cup sidewall, the cup base, the yoke bottom and back to the magnet, and wherein the second magnetic flux runs from the magnet to the second plate portion, the second gap passing through the tweeter voice coil, the central pole, the bottom yoke and back to the magnet.

According to some embodiments, the yoke base further comprises a yoke geometrical separating feature.

According to some embodiments, the cup further comprises a cup cable aperture, the yoke further comprises a yoke cable aperture, the magnet further comprises a magnet cable aperture, the top plate further comprises a top plate cable aperture and the tweeter alignment component further comprises a tweeter cable aperture. Wherein the cup cable aperture, the yoke cable aperture, the magnet cable aperture, the top plate cable aperture and the tweeter cable aperture are vertically aligned.

According to some embodiments, the speaker driver further comprises a chassis having a chassis base, and a cup yoke (the cup yoke having a center pole, a first yoke base portion having an upper surface, a second yoke base portion having an upper surface, and a cup yoke sidewall, wherein the upper surface of the first yoke base portion is vertically lower than the upper surface of the second yoke base portion, wherein the second yoke base portion is disposed on the chassis base, wherein the woofer voice coil is disposed within a first gap formed between the cup yoke sidewall and the magnet outer circumference, and wherein the tweeter voice coil is disposed within a second gap formed between the center pole and the magnet inner circumference). Wherein the first magnetic flux runs from the magnet to the first plate portion, the first gap passing through the woofer voice coil, the cup yoke sidewall, the second yoke base, the first yoke base and back to the magnet, and wherein the second magnetic flux runs from the magnet to the second plate portion, the second gap passing through the tweeter voice coil, the central pole, the first yoke base and back to the magnet.

According to some embodiments, the second yoke base portion further comprises a yoke geometrical separating feature. According to some embodiments, the cup yoke further comprises a cup yoke cable aperture, the magnet further comprises a magnet cable aperture, the top plate further comprises a top plate cable aperture and the tweeter alignment component further comprises a tweeter cable aperture. Wherein the cup cable aperture, the yoke cable aperture, the magnet cable aperture, the top plate cable aperture and the tweeter cable aperture are vertically aligned.

According to some embodiments, the speaker driver further comprises a spider.

According to some embodiments, the spider comprises a spider corrugation portion having spider outer circumferential portion, a spider rising portion, a spider neck portion, and at least one reinforcement rib, extending from at least a portion of the spider rising portion to at least a portion of the spider neck portion. Wherein the spider corrugation portion, the spider rising portion and the spider neck portion are formed as a single composite piece, and wherein the spider is attached to the chassis via the spider outer circumferential portion, and to the woofer voice coil and the woofer diaphragm via the spider neck portion.

Certain embodiments of the present invention may include some, all, or none of the above advantages. Further advantages may be readily apparent to those skilled in the art from the figures, descriptions, and claims included herein. Aspects and embodiments of the invention are further described in the specification herein below and in the appended claims.

Unless otherwise defined, all technical and scientific terms used herein have the same meaning as commonly understood by one of ordinary skill in the art to which this invention pertains. In case of conflict, the patent specification, including definitions, governs. As used herein, the indefinite articles "a" and "an" mean "at least one" or "one or more" unless the context clearly dictates otherwise.

The following embodiments and aspects thereof are described and illustrated in conjunction with systems, tools and methods which are meant to be exemplary and illustrative, but not limiting in scope. In various embodiments, one or more of the above-described problems have been reduced or eliminated, while other embodiments are directed to other advantages or improvements.

BRIEF DESCRIPTION OF THE FIGURES

Some embodiments of the invention are described herein with reference to the accompanying figures. The description, together with the figures, makes apparent to a person having ordinary skill in the art how some embodiments may be practiced. The figures are for the purpose of illustrative description and no attempt is made to show structural details of an embodiment in more detail than is necessary for a fundamental understanding of the invention. For the sake of clarity, some objects depicted in the figures are not to scale.

In the Figures.

DETAILED DESCRIPTION OF SOME EMBODIMENTS

Figure 1:
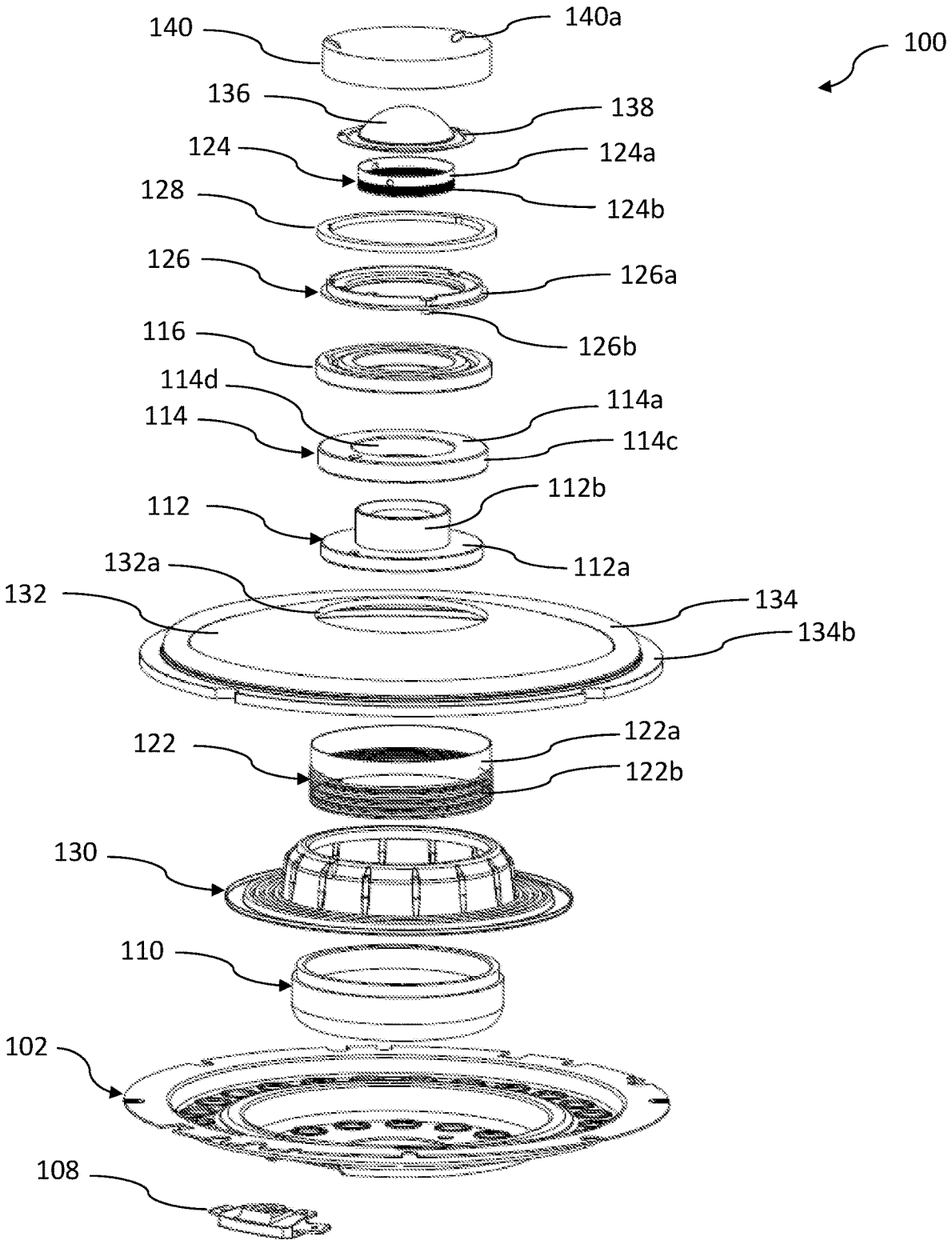
FIG. 1 constitutes an exploded view in perspective of components of a speaker driver, according to some embodiments.

In the following description, various aspects of the disclosure will be described. For the purpose of explanation, specific configurations and details are set forth in order to provide a thorough understanding of the different aspects of the disclosure. However, it will also be apparent to one skilled in the art that the disclosure may be practiced without specific details being presented herein. Furthermore, well-known features may be omitted or simplified in order not to obscure the disclosure. In the figures, like reference numerals refer to like parts throughout.

Figure 2:
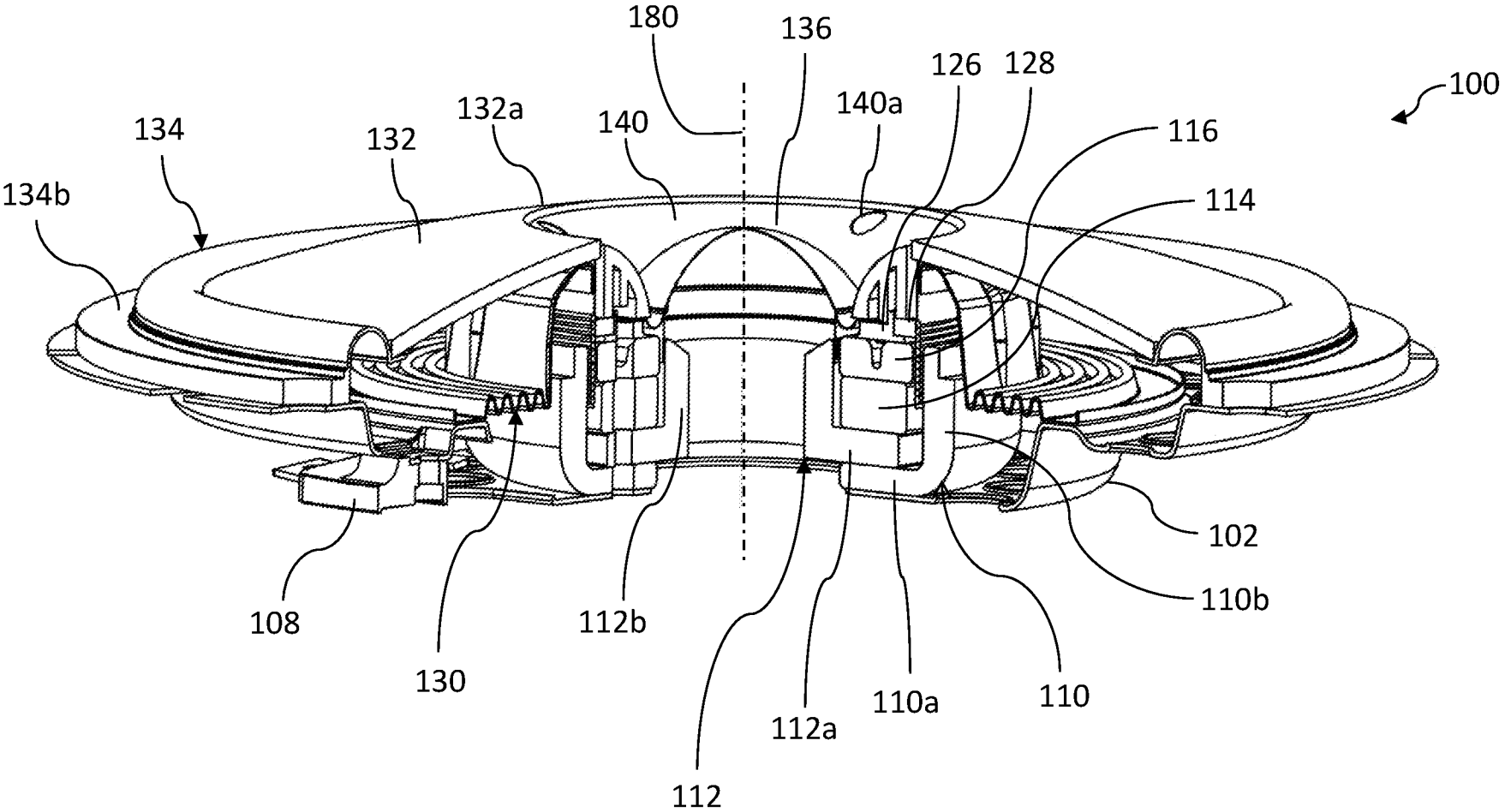
FIG. 2 constitutes a cut-away view in perspective of a speaker driver, according to some embodiments.
Figure 3:
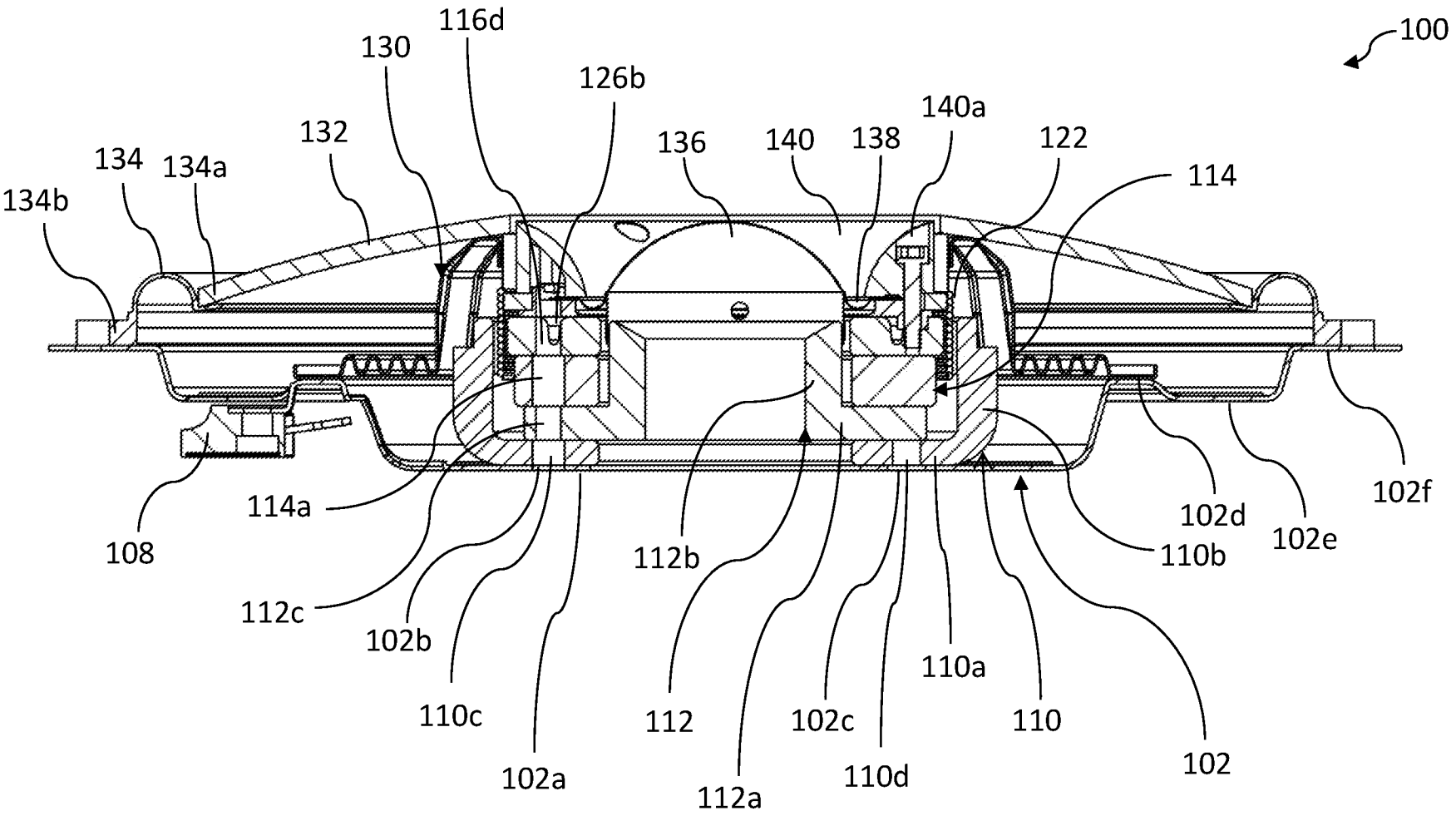
FIG. 3 constitutes a cross-sectional view of a speaker driver, according to some embodiments.

According to an aspect of some embodiments, there is provided a speaker driver 100. Reference is now made to FIGS. 1-5*d*. FIG. 1 constitutes an exploded view in perspective of components of speaker driver 100. FIGS. 2 and 3 constitute a cut-away view in perspective and a cross-sectional view, respectively, of speaker driver 100. Speaker driver 100, as disclosed herein, is supported by a chassis 102, also known as a basket or a frame, which has a chassis base 102*a* and a chassis rim 102*f* for supporting a woofer surround 134. Woofer surround 134 is attached on one end to a woofer diaphragm 132 via woofer surround lip 134*a*, and attached on the other end to chassis rim 102*f* via woofer surround rim 134*b* (see FIG. 3).

Chassis base 102*a* supports magnetic circuits 104 and 106 (indicated in FIGS. 5*a*-5*d*), both sharing a single magnet 114, and at least one magnetically permeable component. Magnetically permeable components include a woofer cup 110, a T-yoke 112 and a top-plate 116. Magnet 114 includes a magnet top portion 114*a*, a magnet bottom portion 114*b*, a magnet outer circumference 114*c* and a magnet inner circumference 114*d* (see FIGS. 1 and 4). Woofer cup 110, placed on top of chassis base 102*a*, is configured by two integral parts: a cup base 110*a* and a cup sidewall 110*b* extending from it. T-yoke 112, placed on top of woofer cup 110, includes a bottom yoke 112*a* extending to a center pole 112*b*.

The terms "yoke" and "T-yoke", as used herein, are interchangeable.

Woofer diaphragm 132, configured to operate in a lower frequency band, is secured to a woofer voice coil 122. Tweeter diaphragm 136, configured to operate in a higher frequency band and provided with a tweeter voice coil 124, is arranged concentric to woofer diaphragm 132. Longitudinal axis 180 is preferably an axis of radial symmetry for woofer diaphragm 132 and tweeter diaphragm 136 and is the reference from which radial direction discussed below originates. Vertical direction, as used herein, is defined as the direction along longitudinal axis 180.

The term "low frequency band", as used herein, refers to any frequency range between the boundaries of 20-10,000 Hz, such as, for example, a range of 40-2,000 Hz.

The term "high frequency band", as used herein, refers to any frequency range between the boundaries of 1,000-120,000 Hz, such as, for example, a range of 2,000-20,000 Hz.

According to some embodiments, top plate 116 is adjacent on a horizontal plane to magnet 114, such as the horizontal plane of magnet top portion 114*a* or the horizontal plane of magnet bottom portion 114*b*. According to some embodiments (see FIGS. 1-4), magnet 114 is provided between top plate 116 and yoke 112, such that top plate 116 is adjacent on a horizontal plane of magnet top portion 114*a*, and bottom yoke 112*a* is adjacent on a horizontal plane to magnet bottom portion 114*b*. Top plate 116 is separated from cup sidewall 110*b* by a first gap 118, and from center pole 112*b* by a second gap 120, respectively (See FIG. 4).

Woofer voice coil 122 is disposed within first gap 118 around magnet outer circumference 114*c*. Woofer voice coil 122 includes a woofer voice coil wire 122*b* wound around a woofer former 122*a*. Tweeter voice coil 124 is disposed within second gap 120 around magnet inner circumference 114*d*. Tweeter voice coil 124 includes a tweeter voice coil wire 124*b* wound around a tweeter former 124*a*. Woofer voice coil 122 and tweeter voice coil 124 are sized and arranged to enable vertical movement of woofer former 122*a* and tweeter former 124*a* within first gap 118 and second gap 120, respectively.

The term "horizontal plane", as used herein, refers to a plane perpendicular to longitudinal axis 180.

The term "adjacent on a horizontal plane", as used herein, more specifically refers to a first component being adjacent on a horizontal plane to a second component, such that a surface of the first component is in contact with a surface of the second component, the surface of the second component defining the horizontal plane of contact.

It is preferred that each of chassis 102, woofer cup 110, spider 130, T-yoke 112, magnet 114 and top plate 116 are ring shaped. However, it is to be understood that any or each of the components fulfill the function when otherwise shaped, as in a rectangle, triangle, rhombus, parallelogram, oval, star, pentagon, hexagon, octagon, or other polygon.

It is preferred that each one of chassis 102, woofer cup 110, spider 130, T-yoke 112, magnet 114 and top plate 116 is formed as a single integral component. However, it is to be understood that any or each of the components fulfill the function when formed from several parts combined together to form the component.

According to some embodiments, woofer voice coil 122 and tweeter voice coil 124 are horizontally aligned, such that the middle point along the vertical length of woofer voice coil wire 122*b* and the middle point along the vertical length of tweeter voice coil wire 124*b* are substantially in the same horizontal plane. Advantageously, this arrangement provides time-alignment between woofer voice coil 122 and tweeter voice coil 124, thereby providing better acoustic performance of speaker driver 100. Moreover, the overall configuration of speaker driver 100, with special emphasis on time alignment between woofer voice coil 122 and tweeter voice coil 124, enable such arrangement to be utilized not only for loudspeakers but also for headphones, providing a simple time-aligned technological solution to cover both low (woofer) and high (tweeter) frequency ranges without compromising acoustic performance.

According to some embodiments, woofer voice coil 122 and tweeter voice coil 124 are not aligned horizontally, such that the middle point along the vertical length of woofer voice coil wire 122*b* and the middle point along the vertical length of tweeter voice coil wire 124*b* are not positioned substantially in the same horizontal plane.

The term "substantially in the same horizontal plane", as used herein, refers to being at the same vertical height along longitudinal axis 180, or being at heights that vertically do not deviate from one another more than 10% of the radial distance between the entities referred to as being substantially in the same horizontal plane.

The term "vertically aligned", as used herein, refers to positioning of at least two elements in a manner that each element's axis of symmetry, parallel to longitudinal axis 180, is positioned at a substantially identical radial distance from longitudinal axis 180.

The term "substantially identical", as used herein, means the same or deviates by no more than 10% from one another.

Figure 4:
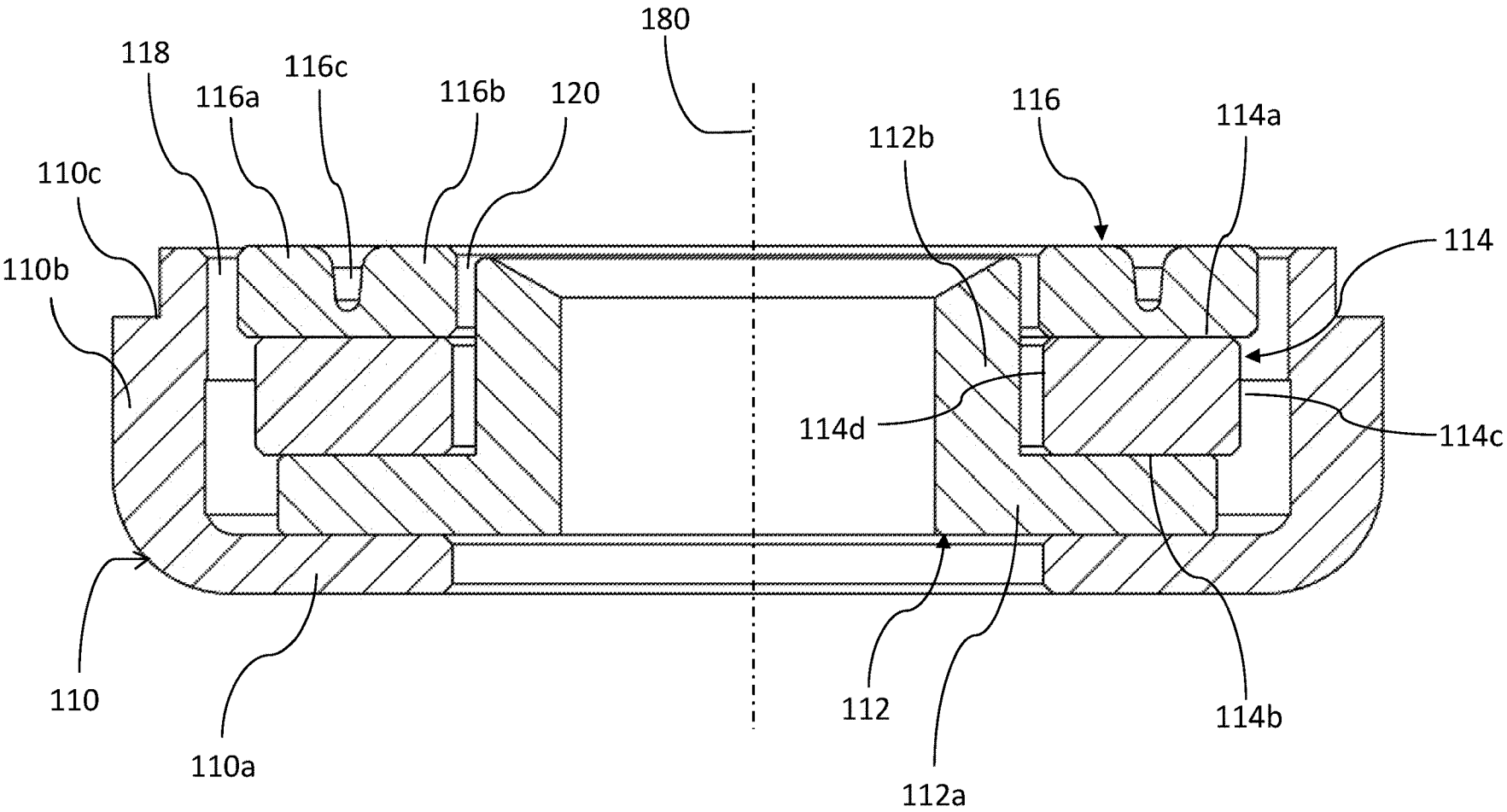
FIG. 4 constitutes a cross-sectional view of a subassembly of a speaker driver, according to some embodiments.

FIG. 4 constitutes a cross-section view of a subassembly of speaker driver 100. Top plate 116 is provided with a geometrical separating feature 116*c*. According to some embodiments, such as the embodiments illustrated in FIG. 4, geometrical separating feature 116*c* is configured as a circumferential recess, separating between a first plate portion 116*a* and a second plate portion 116*b*. The cross-sectional shape of geometrical separating feature 116*c* is illustrated in FIG. 4 as a recess having a dome-shaped socket in the middle, extending to a rectangular cross section formed with corresponding slopes tapered vertically towards the direction of woofer diaphragm 132, either radially outwards when extending towards first plate portion 116*a*, or radially inwards when extending towards second plate portion 116*b*. It is to be understood, however, that the cross-sectional geometry of geometrical separating feature 116*c* is optionally different, such as a circular, triangular or any other curvilinear or rectilinear cross-section.

Figure 5A:
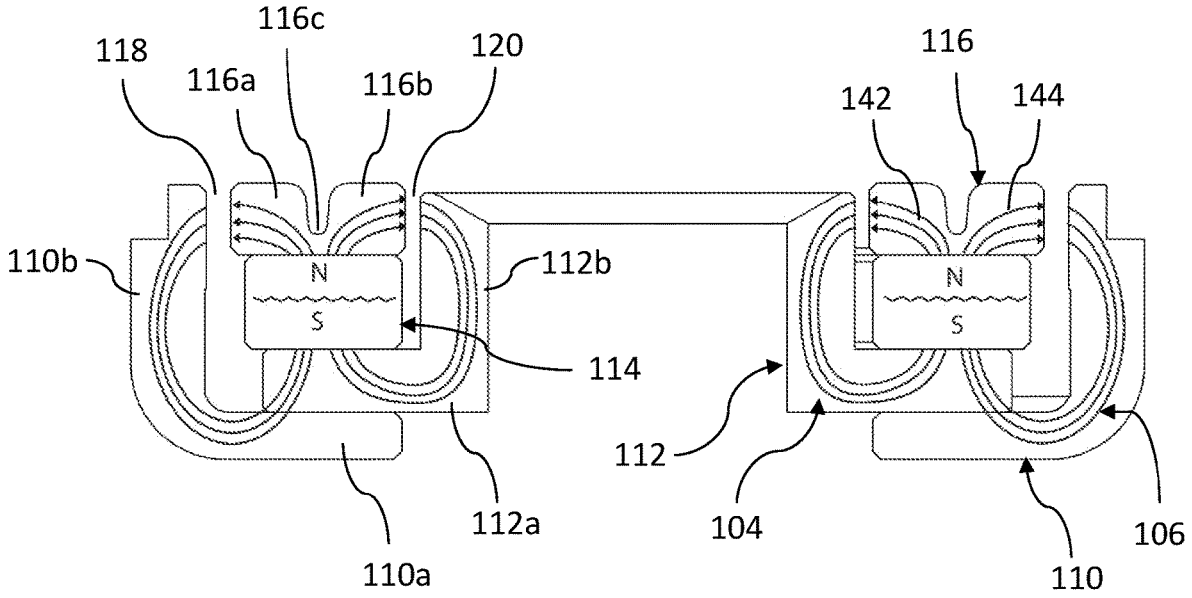
FIG. 5*a* constitutes a cross-sectional view depicting magnetic flux through a subassembly of a speaker driver, according to some embodiments.

Reference is now made to FIG. 5*a*-5*d*. FIG. 5*a*-5*d* constitute a cross-sectional view depicting magnetic flux through different embodiments of components of the subassembly presented in FIG. 4. FIGS. 5*a*-5*d* are provided without section hatching lines for ease in viewing and understanding the schematic depiction of magnetic flux lines. Both first magnet circuit 104 and second magnet circuit 106 are defined by the same magnet 114, in two opposite directions as depicted in FIG. 5*a*. First flux lines 142 of first magnet circuit 104 flow from the north pole of magnet 114 to first plate portion 116*a*, on towards first gap 118, through cup sidewall 110*b* and cup base 110*a* of woofer cup 110, on to bottom yoke 112*a* and finally to the south pole of magnet 114. Second flux lines 144 of second magnet circuit 106 flow from the north pole of magnet 114 to second plate portion 116*b*, passing through second gap 120 towards center pole 112*b* and bottom yoke 112*a* of T-yoke 112, on to the south pole of magnet 114.

Advantageously, geometrical separating feature 116*c* concentrates first flux lines 142 and second flux lines 144 passing through first plate portion 116*a* and second plate portion 116*b*, respectively, allowing for increased magnetic flux efficiency.

Figure 5B:
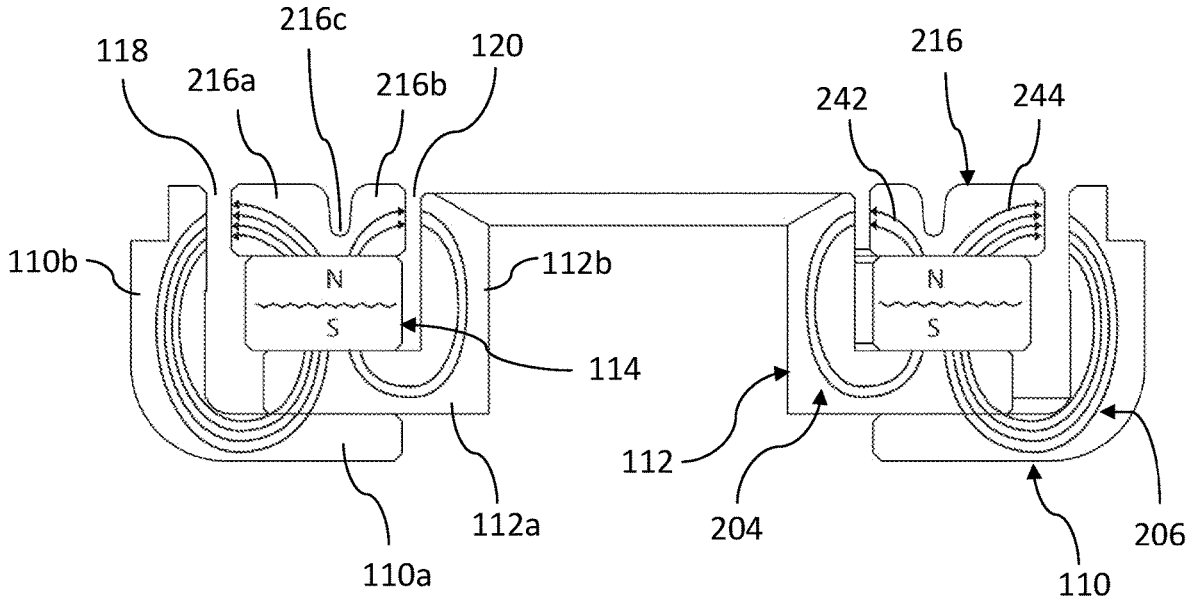
FIG. 5*b* constitutes a cross-sectional view depicting magnetic flux through a subassembly of a speaker driver, according to some embodiments.

Another advantage of geometrical separating feature 116*c* is that the intensity of the magnetic field in first 104 and second 106 magnet circuits is changed by the radial location of geometrical separating feature 116*c* along top plate 116. While FIG. 5*a* presents an embodiment of top plate 116 wherein geometrical separating feature 116*c* is radially located at the middle of top plate 116. FIG. 5*b* illustrates another embodiment of top plate 216 in which geometrical separating feature 216*c*, separating between first plate portion 216*a* and second plate portion 216*b*, is located radially closer to second air gap 120.

The amount of the illustrated flux lines is representative of the intensity of the magnetic field in each magnetic circuit, such that a configuration of the embodiment illustrated in FIG. 5*b* results in a stronger magnetic field, as indicated by a higher amount of illustrated first flux lines 242, passing through first magnet circuit 204, than the magnetic field of second magnet circuit 206, as indicated by a lower amount of illustrated second flux lines 242, passing there through. In this configuration, a greater amount of the magnetic field is passing through first gap 118 than through second gap 120. Thus, the radial position of geometrical separating feature 216*c* is optionally configured, during a manufacturing process, according to a desired split of magnetic field intensity between first gap 118, within which woofer voice coil 122 is suspended, and second gap 120, within which tweeter voice coil 124 is suspended.

Figure 5C:
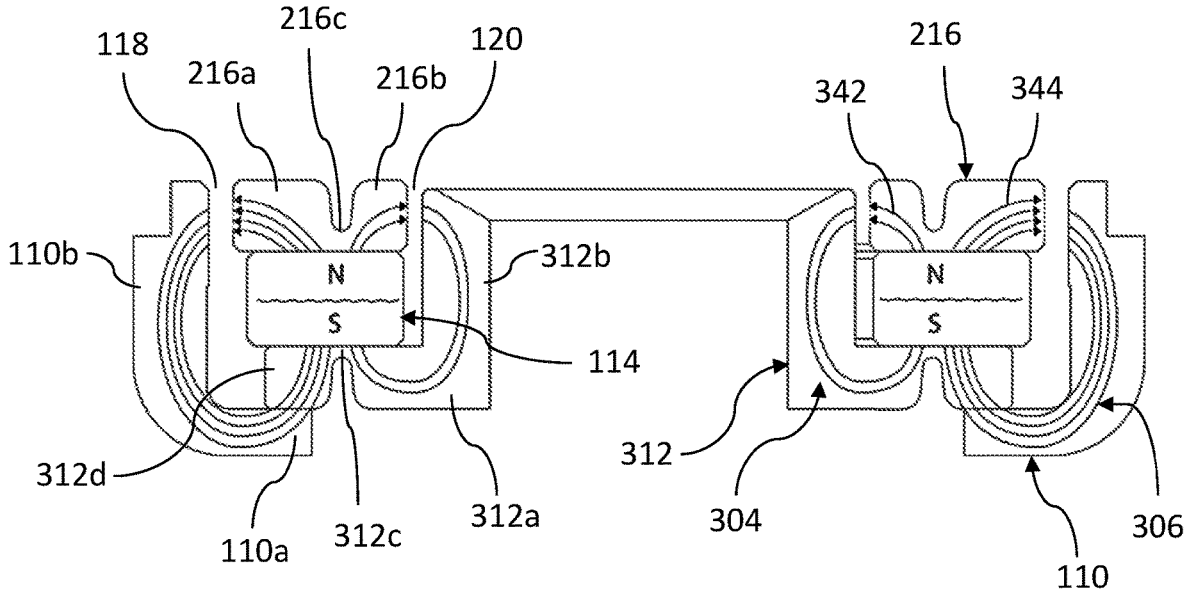
FIG. 5*c* constitutes a cross-sectional view depicting magnetic flux through a subassembly of a speaker driver, according to some embodiments.

FIG. 5*c* illustrates yet another embodiment which differs from the embodiments of FIG. 5*b* in that T-yoke 112 is replace by T-yoke 312, comprising a bottom yoke 312*a* and a center pole 312*b*. Bottom yoke 312*a* differs from bottom yoke 112*a* in that it includes a yoke geometrical separating feature 312*c*, vertically aligned with geometrical separating feature 216*c* of top plate 216. According to some embodiments, the cross-sectional geometry of geometrical separating feature 312*c* is similar to that of geometrical separating feature 216*c*, except that the profile of the former is vertically inverted, having its open end facing chassis base 102*a*.

According to some embodiments, the cross-sectional geometry of geometrical separating feature 312*c* differs from that of geometrical separating feature 216*c*. First flux lines 342 of first magnet circuit 304 flow from the north pole of magnet 114 to first plate portion 216*a*, on towards first gap 118, through cup sidewall 110*b* and cup base 110*a* of woofer cup 110, on to bottom yoke 312*a* and finally to the south pole of magnet 114. Second flux lines 344 of second magnet circuit 306 flow from the north pole of magnet 114 to second plate portion 216*b*, passing through second gap 120 towards center pole 312*b* and bottom yoke 312*a* of T-yoke 312, on to the south pole of magnet 114.

Advantageously, geometrical separating feature 312*c* further contributes to focusing and adjusting the magnetic flux intensity of each of magnetic circuits 304 and 306. According to some embodiments, magnetic circuits 304 and 306 include T-yoke 312 and top-plate 116, such that yoke geometrical separating feature 312*c* is vertically aligned with geometrical separating feature 116*c*. According to some embodiments, magnetic circuits 304 and 306 include T-yoke 312 and a top plate that does not include a geometrical separating feature (not shown), such that focusing and adjusting the intensity of each of magnetic circuits 304 and 306 is achieved solely due to yoke geometrical separating feature 312*c*, and not due to a top-plate having both upper and lower surfaces substantially flat.

Figure 5D:
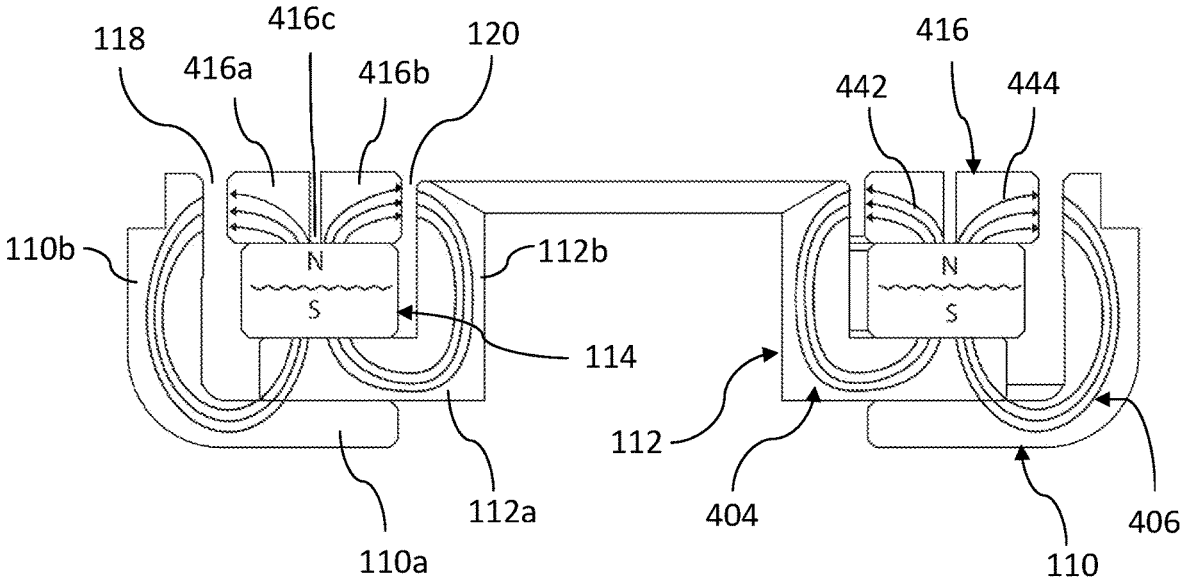
FIG. 5*d* constitutes a cross-sectional view depicting magnetic flux through a subassembly of a speaker driver, according to some embodiments.

FIG. 5*d* illustrates yet another embodiment which differs from the embodiment of FIG. 5*a* in that upper plate 116 is replaced by upper plate assembly 416, having first upper plate 416*a* and second upper plate 416*b* divided by a top-plate separation gap 416*c*. First flux lines 442 of first magnet circuit 404 flow from the north pole of magnet 114 to first upper plate 416*a*, on towards first gap 118, through cup sidewall 110*b* and cup base 110*a* of woofer cup 110, on to bottom yoke 112*a* and finally to the south pole of magnet 114. Second flux lines 444 of second magnet circuit 406 flow from the north pole of magnet 114 to s second upper plate 416*b*, passing through second gap 120 towards center pole 112*b* and bottom yoke 112*a* of T-yoke 112, on to the south pole of magnet 114. According to some embodiments, radial location of top-plate separation gap 416*c* differ, influencing the radial dimensions of first upper plate 416*a* and second upper plate 416*b* so as to adjust the intensity of each of magnetic circuits 404 and 406.

It is understood that the schematic depiction of magnetic flux lines in FIGS. 5*a*-5*d* are for purposes of explanation only and that varying and/or additional flux lines may be present.

According to some embodiments, magnet 114 is a permanent magnet, such as, but not limited to, ceramic, ferrite or Alnico magnets.

According to some embodiments, magnet 114 is a neodymium magnet (NdFe35). Neodymium creates a strong magnetic field using a smaller volume of material as compared to ferrite, for example, and has a high mechanical strength to sufficiently prevent breakage thereof. Advantageously, using neodymium results in a smaller volume required for magnet 114, compared to ferrite, to generate the same magnetic flux. Advantageously, using a neodymium magnet saves space, allowing it to be incorporated within a shallow driver 100, which allow mounting in a narrow spaces, such as the inside of vehicles. Moreover, the mechanical strength provided by neodymium enables magnet 114 to be provided, according to some embodiments, with magnet cable aperture 114*e*, without risking breakage of magnet 114 as a result.

Advantageously, the inclusion of woofer cup 110 as an additional magnetically permeable component in second magnet circuit 106 (as well as other embodiments of second magnet circuit 206, 306, 406), in addition to top plate 116 and T-yoke 112, allows for a more efficient utilization of magnetic flux generated by a neodymium magnet 114, compared to a magnet circuit absent of woofer cup 110.

The vertical height (not numbered) of first gap 118 is configured to allow vertical displacements of woofer voice coil 122 without hitting cup base 110*a*. The vertical height (not numbered) of second gap 120 is configured to allow vertical displacements of tweeter voice coil 122 without hitting bottom yoke 112*a*. According to some embodiments, the vertical height of first gap 118 is higher than the vertical height of second gap 120, thereby allowing for a larger vertical displacement of woofer voice coil 122 than that of tweeter voice coil 124.

Figure 6A:
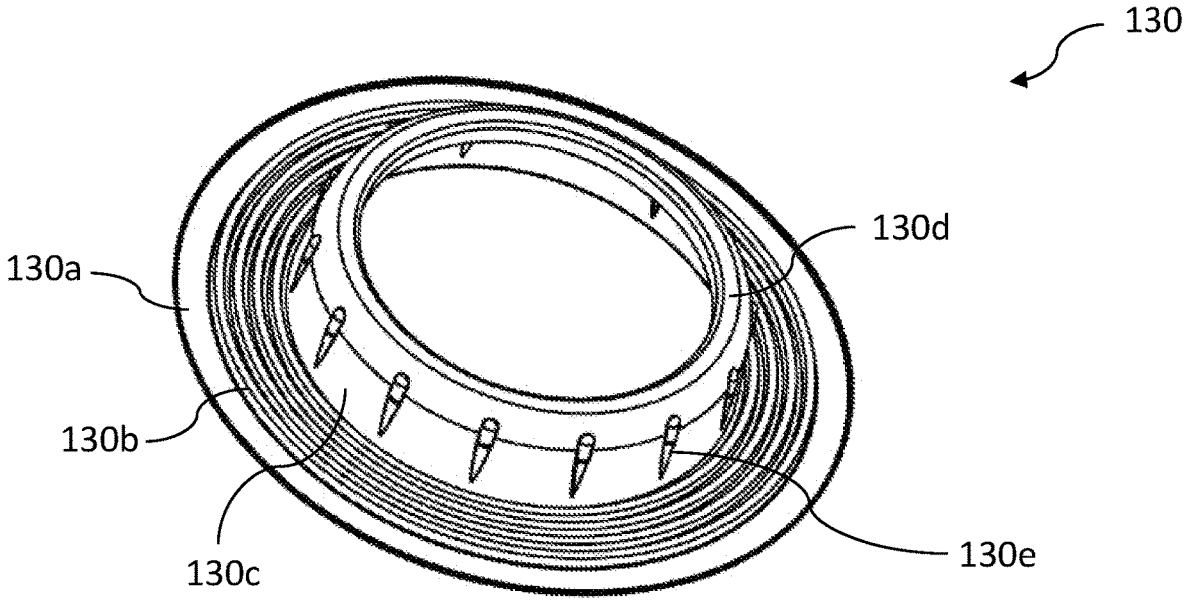
FIG. 6*a* constitutes a view in perspective of a spider, according to some embodiments.
Figure 6B:
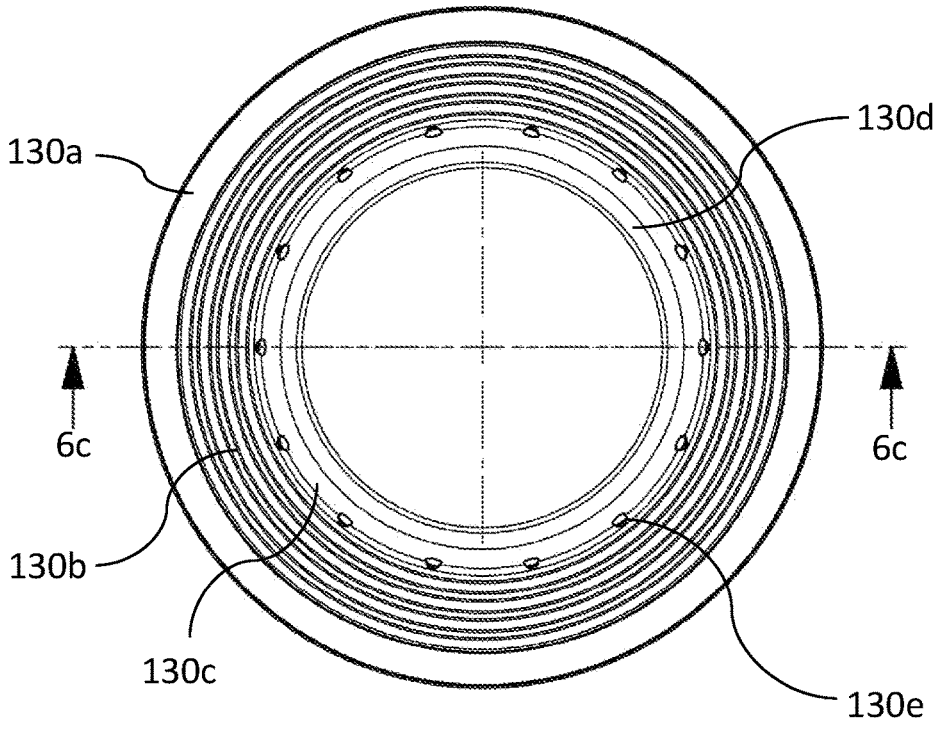
FIG. 6*b* constitutes a top-view of a spider, according to some embodiments.
Figure 6C:
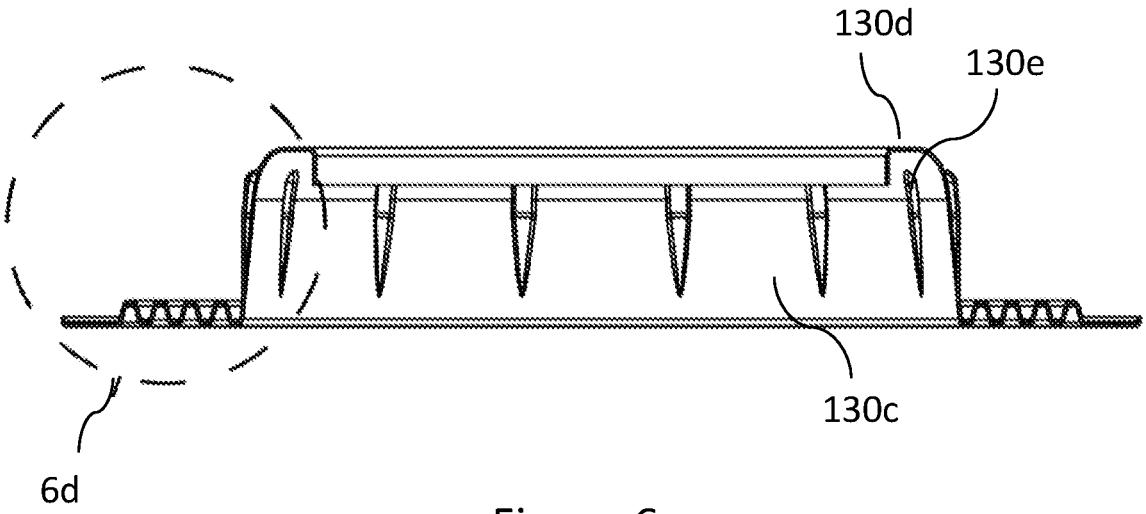
FIG. 6*c* constitutes a cross-sectional view of a spider taken on line 6*c*-6*c* of FIG. 6*b*, according to some embodiments.
Figure 6D:
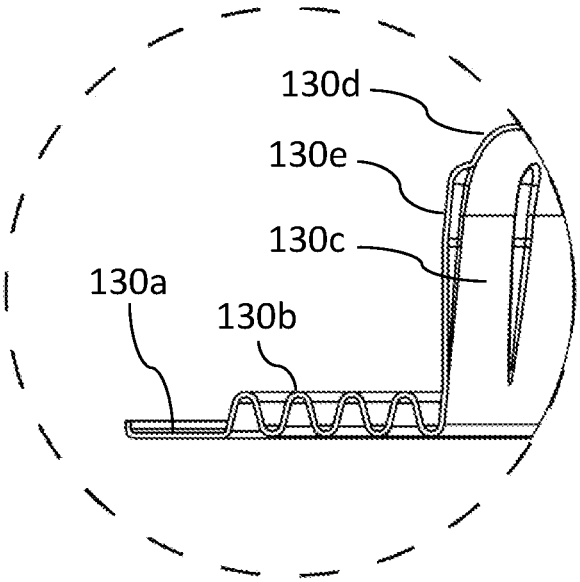
FIG. 6*d* constitutes an enlarged view of a spider taken on region 6*d* of FIG. 6*c*, according to some embodiments.

Reference is now made to FIGS. 6*a*-6*d*. FIGS. 6*a* and 6*b* constitute a view in perspective and a top-view, respectively, of a spider 130, according to some embodiments. FIG. 6*c* constitutes a cross-sectional view of spider 130 taken on line 6*c*-6*c* of FIG. 6*b*. FIG. 6*d* constitutes an enlarged view of spider 130 taken on region 6*d* of FIG. 6*c*. Spider 130 includes a spider corrugation portion 130*b* having a spider outer circumferential portion 130*a* on one end, and extending to a spider rising portion 130*c* on the other end. Spider rising portion 130*c* further extends to a spider neck portion 130*d*. A plurality of reinforcing ribs 130*e* are circumferentially arranged around spider rising portion 130*b*, extending in the vertical direction along at least a portion of the vertical length of rising portion 130*b* and at least a portion of the radial length of spider neck portion 130*d*. Spider neck portion 130*d* is attached to both woofer former 122*a* and woofer diaphragm 132, while spider corrugation portion 130*b* is attached, via spider outer circumferential portion 130*a*, to chassis 102.

Advantageously, reinforcing ribs 130*e* provide spider neck portion 130*d* and spider rising portion 130*c* more resistance to flexing during movements of woofer diaphragm 136 and woofer former 122*a* in the vertical as well as radial directions. Spider corrugation portion 130*b* includes a plurality of radially undulate circumferential corrugations (not numbered), which provide for radial expansion and contraction of the spider 130. According to some embodiments, spider corrugation portion 130*b*, spider rising portion 130*c* and spider neck portion 130*d* are formed integrally and not as separate pieces that are later connected. According to some embodiments, spider outer circumferential portion 130*a* is a straight horizontal portion extending from the outermost radial corrugation, configured for attachment to chassis first ledge 102*d*.

The term "plurality", as used herein, means more than one.

Figure 7A:
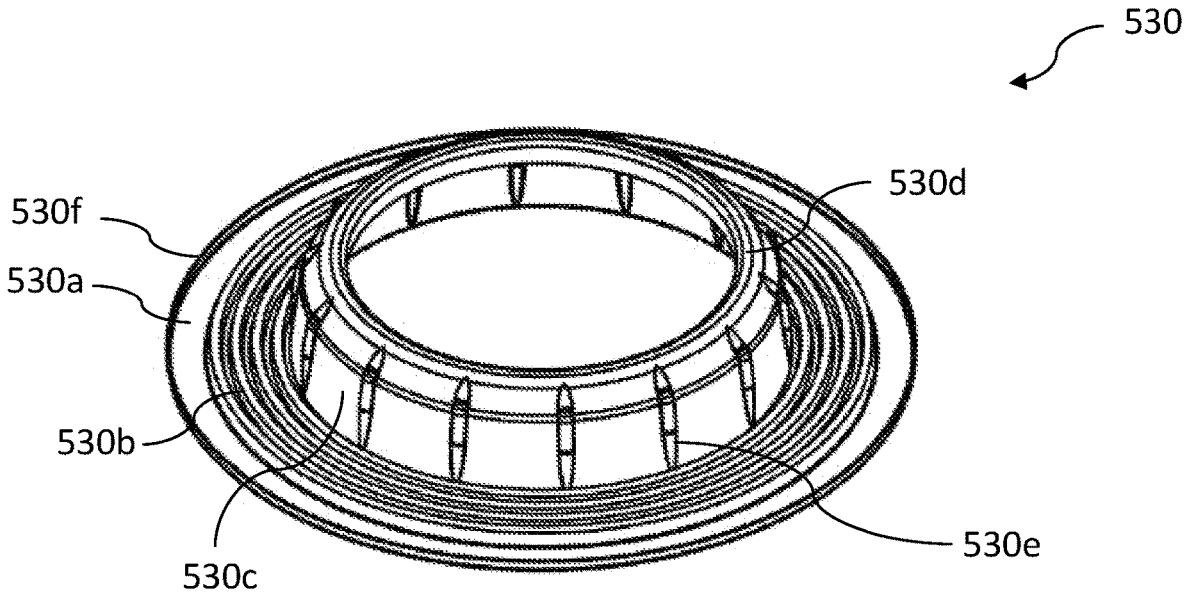
FIG. 7*a* constitutes a view in perspective of a spider, according to some embodiments.
Figure 7B:
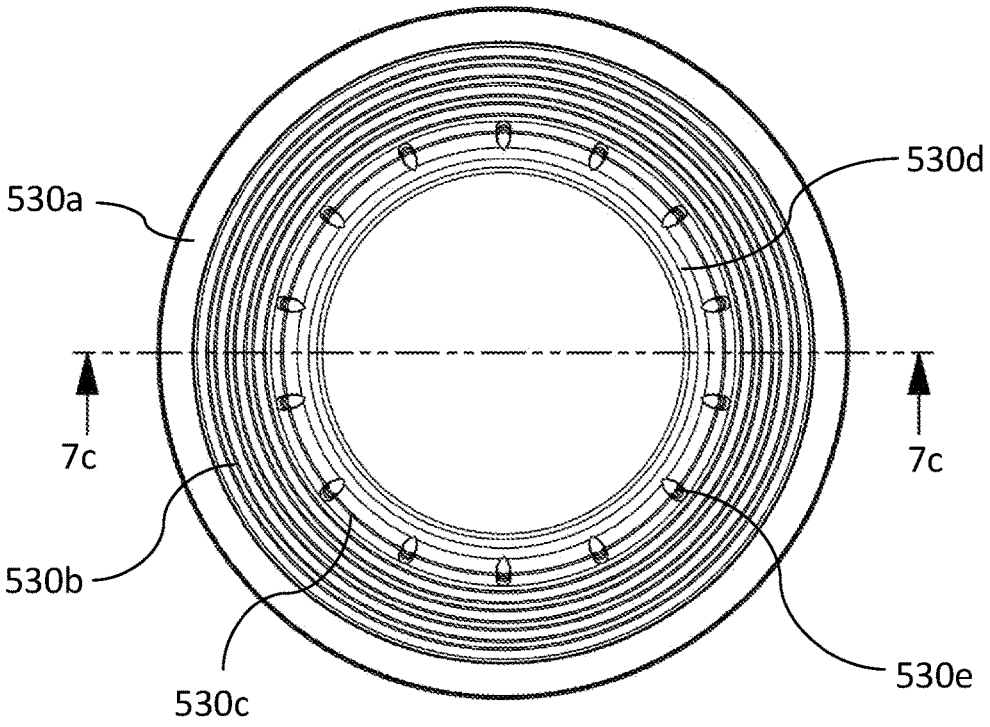
FIG. 7*b* constitutes a top-view of a spider, according to some embodiments.
Figure 7C:
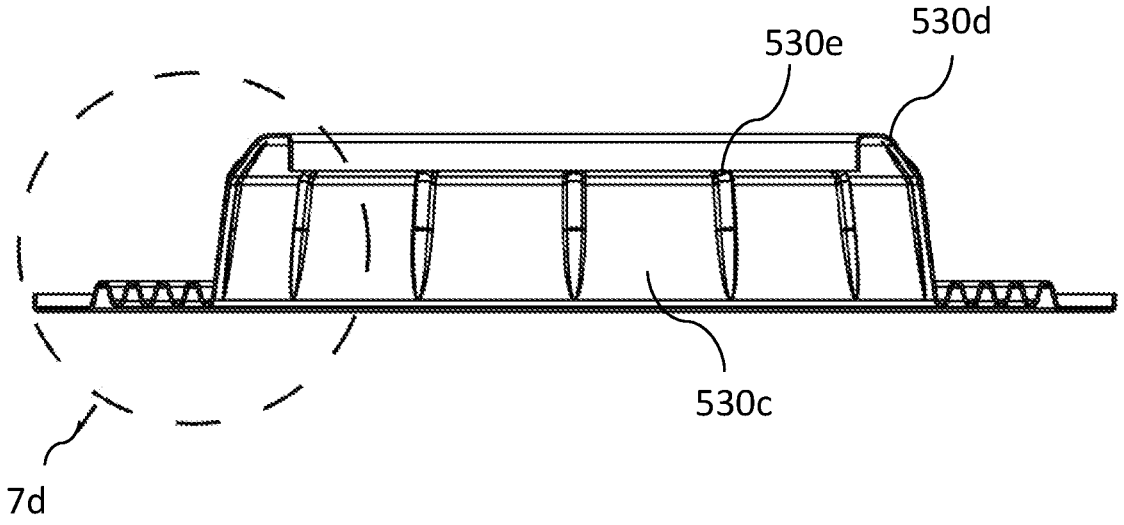
FIG. 7*c* constitutes a cross-sectional view of a spider taken on line 7*c*-7*c* of FIG. 7*b*, according to some embodiments.
Figure 7D:
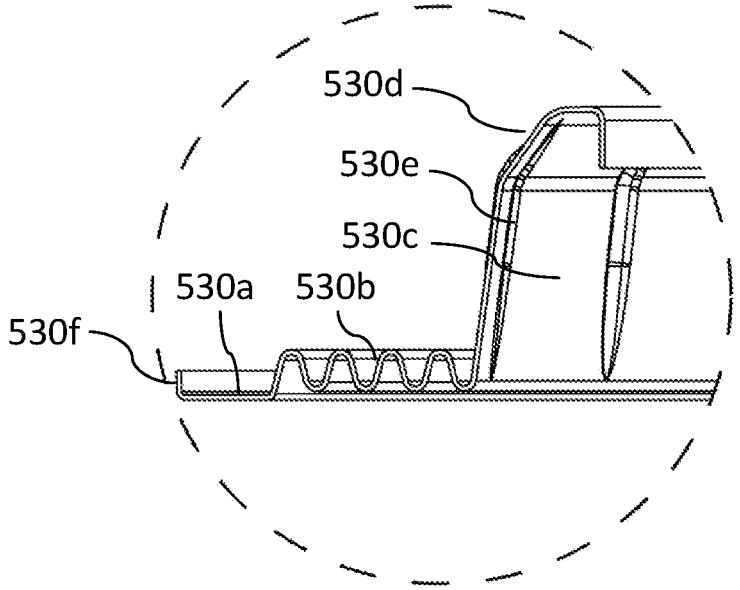
FIG. 7*d* constitutes an enlarged view of a spider taken on region 7*d* of FIG. 7*c*, according to some embodiments.

Reference is now made to FIGS. 7*a*-7*d*, illustrating another embodiment of a spider 530. FIGS. 7*a* and 7*b* constitute a view in perspective and a top-view, respectively, of spider 530. FIG. 7*c* constitutes a cross-sectional view of spider 530 taken on line 7*c*-7*c* of FIG. 7*b*. FIG. 7*d* constitutes an enlarged view of spider 530 taken on region 7*d* of FIG. 7*c*. Similarly to spider 130 illustrated in FIGS. 7*a*-7*d*, spider 530 comprises a spider corrugation portion 530*b* having a spider outer circumferential portion 530*a* on one end, and extending to a spider rising portion 530*c* on the other end. Spider rising portion 530*c* further extends to a spider neck portion 530*d*, and further comprises a plurality of reinforcing ribs 530*e*, circumferentially arranged around spider rising portion 530*b*.

According to some embodiments, reinforcing ribs 530*e* are extending from the edge of connection (not numbered) between spider corrugation portion 530*b* and spider rising portion 530*c*, and cover a longer length in the radial direction, originating from the edge of connection (not numbered) between spider rising portion 530*c* and spider neck portion 530*d*. According to some embodiments, the outer edge of spider outer circumferential portion 530*a* further comprises an extension 530*f* in the vertical direction.

Figure 8A:
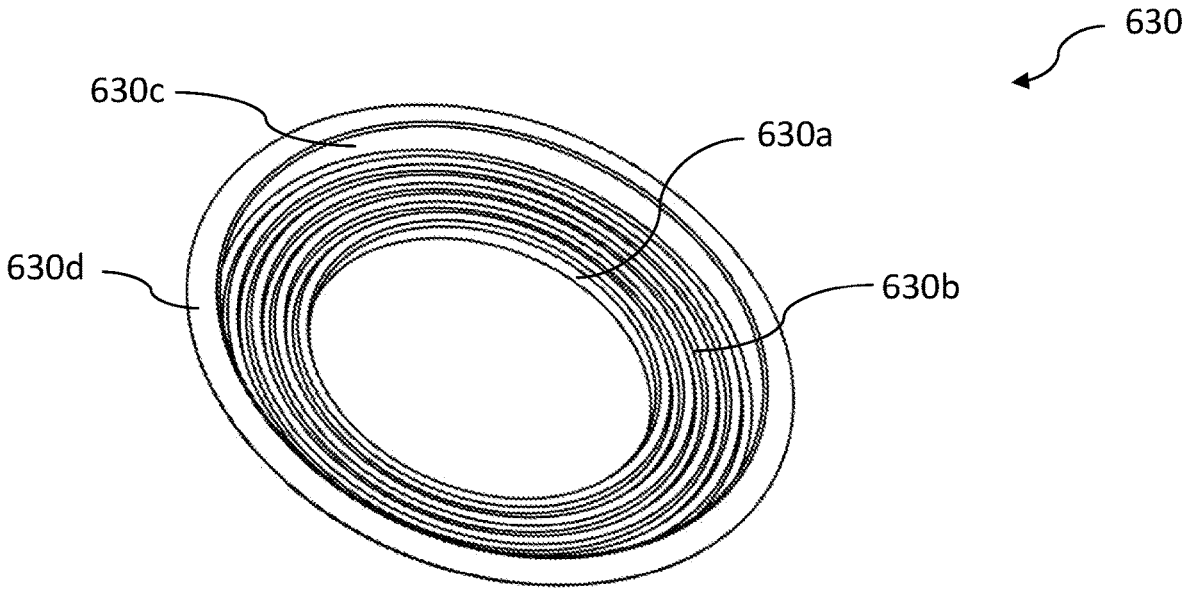
FIG. 8*a* constitutes a view in perspective of a spider, according to some embodiments.
Figure 8B:
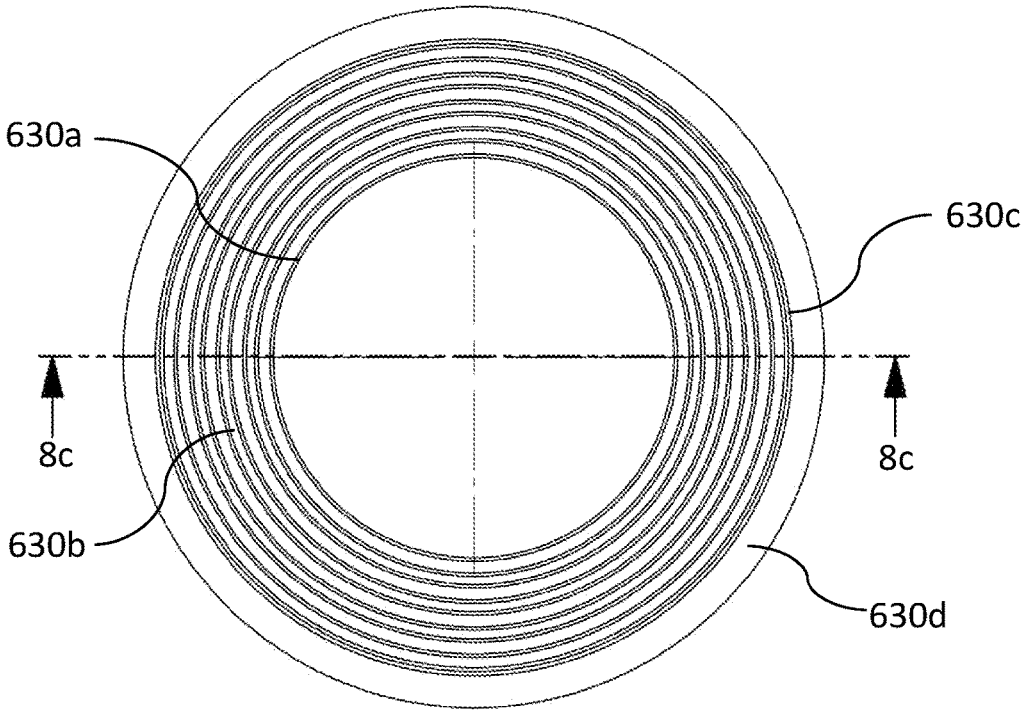
FIG. 8*b* constitutes a top-view of a spider, according to some embodiments.
Figure 8C:
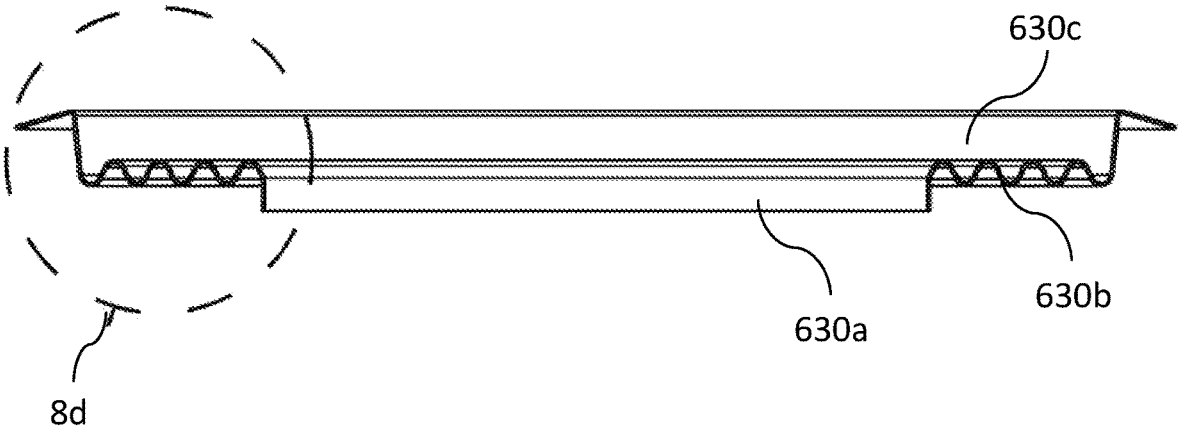
FIG. 8*c* constitutes a cross-sectional view of a spider taken on line 8*c*-8*c* of FIG. 8*b*, according to some embodiments.
Figure 8D:
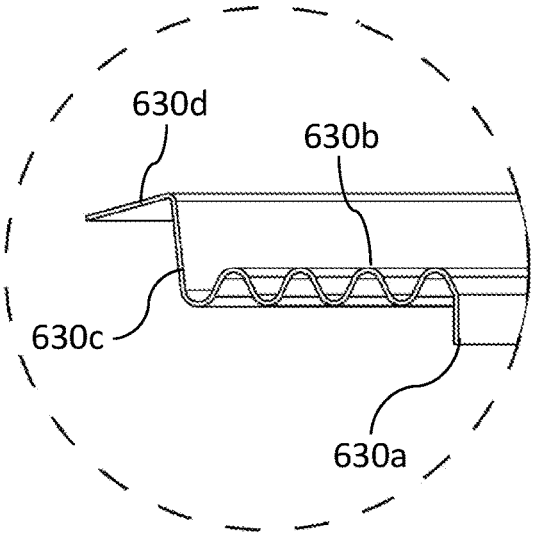
FIG. 8*d* constitutes an enlarged view of region 8*d* marked in FIG. 8*c*, according to some embodiments.

Reference is now made to FIGS. 8*a*-8*d*, illustrating yet another embodiment of a spider 630. FIGS. 8*a* and 8*b* constitute a view in perspective and a top-view, respectively, of spider 630. FIG. 8*c* constitutes a cross-sectional view of spider 630 taken on line 8*c*-8*c* of FIG. 8*b*. FIG. 8*d* constitutes an enlarged view of spider 630 taken on region 8*d* of FIG. 8*c*. Spider 630 comprises a spider corrugation portion 630*b* having a spider inner circumferential portion 630*a* on one end, and extending to a spider rising portion 630*c* on the other end. Spider rising portion 630*c* further extends to spider neck portion 630*d*. Spider neck portion 130*d* is configured for attachment to woofer diaphragm 132, while spider outer circumferential portion is configured for attachment to woofer cup 110. Spider corrugation portion 630*b* includes a plurality of radially undulate circumferential corrugations (not numbered), which provide for radial expansion and contraction of the spider 630.

According to some embodiments, spider corrugation portion 630*b*, spider rising portion 630*c* and spider neck portion 630*d* are formed integrally and not as separate pieces that are later connected. According to some embodiments, spider outer circumferential portion 630*a* is a straight vertical portion extending from the innermost radial corrugation, configured for attachment to cup sidewall 110*b*. According to some embodiments, said attachment is achieved by adhering vertical spider outer circumferential portion 630*a* to cup sidewall 110*b*.

According to some embodiments of the speaker driver 100, reference in this specification to any embodiment of a spider refers to spider embodiments 130, 530 and 630 and spider embodiments old and well known in the art.

Figure 9A:
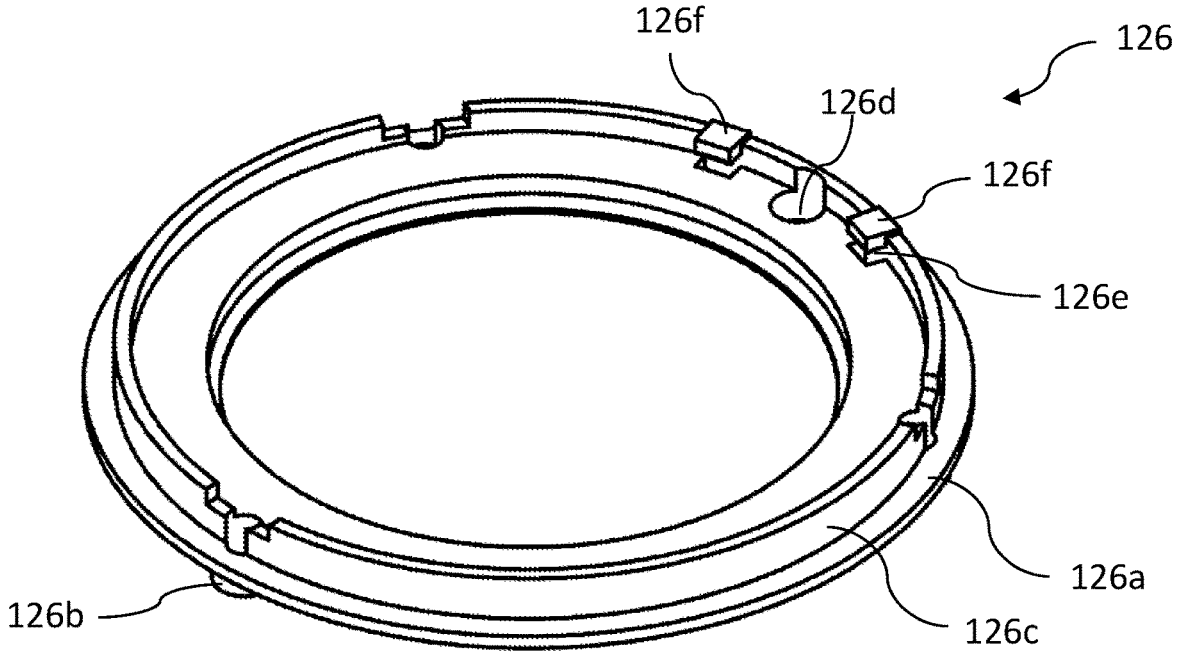
FIG. 9*a* constitutes a view in perspective of a tweeter alignment component, taken from a top-side angle, according to some embodiments.
Figure 9B:
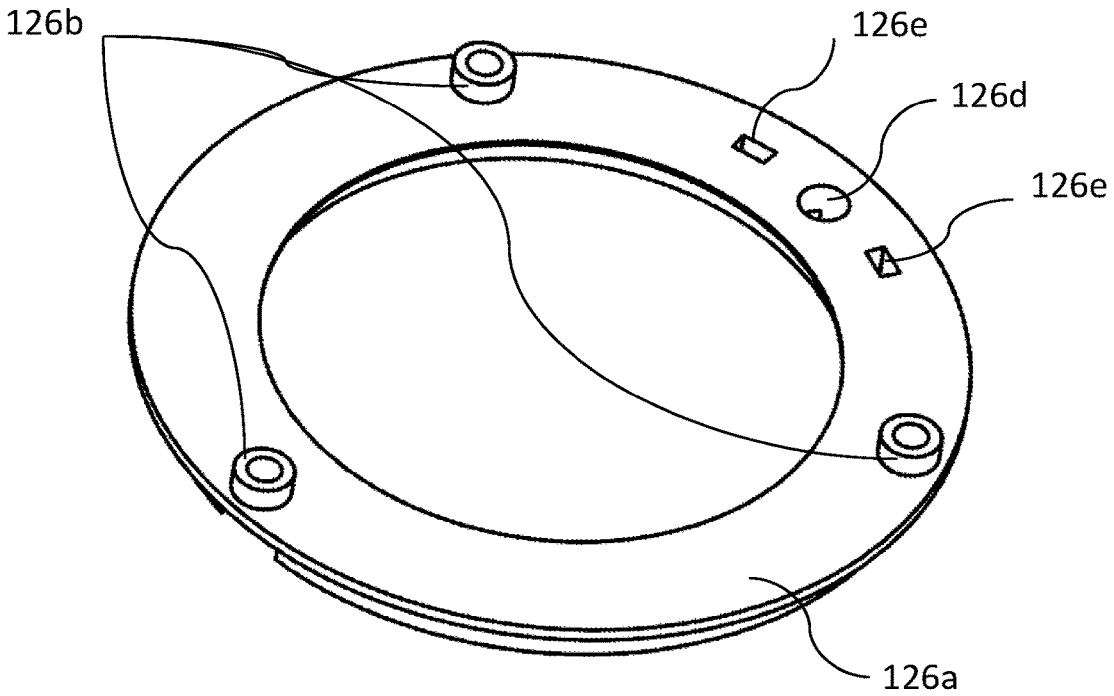
FIG. 9*b* constitutes a view in perspective of a tweeter alignment component, taken from a bottom-side angle, according to some embodiments.
Figure 9C:
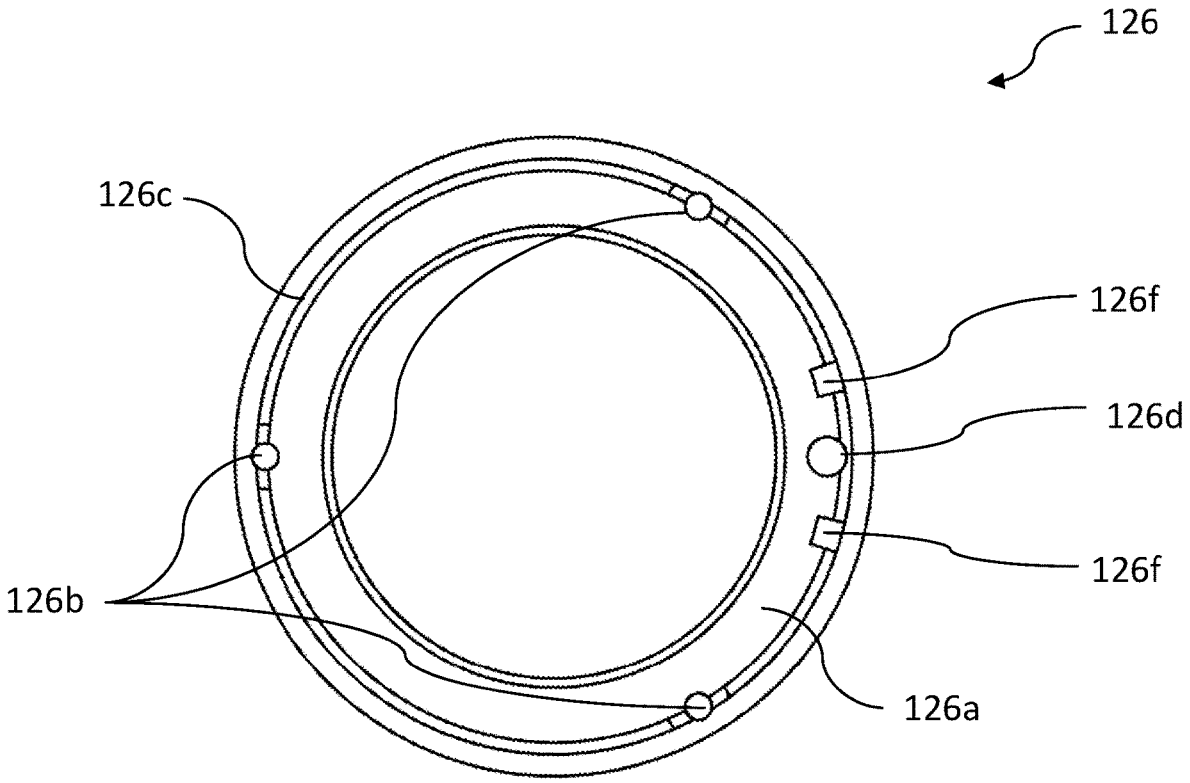
FIG. 9*c* constitutes a top-view of a tweeter alignment component, according to some embodiments.
Figure 9D:
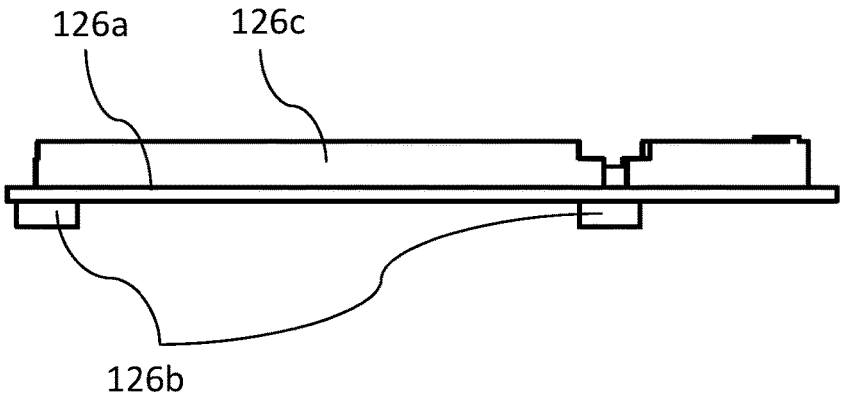
FIG. 9*d* constitutes a side-view of a tweeter alignment component, according to some embodiments.

Reference is now made to FIGS. 9*a*-9*d*. FIGS. 9*a* and 9*b* constitute views in perspective of a tweeter alignment component 126, taken from a top-side angle and from a bottom-side angel, respectively, according to some embodiments. FIGS. 9*c* and 9*d* constitute a top-view and a side-view of tweeter alignment component 126, respectively. Tweeter alignment component 126 includes a tweeter alignment base 126*a*, an alignment circumferential extension 126*c* extending circumferentially from tweeter alignment base 126*a* upwards in the vertical direction, and at least one tweeter alignment protrusion 126*b* protruding from tweeter alignment base 126*a* downwards in the vertical direction.

According to some embodiments, a plurality of tweeter alignment protrusions 126*b* are evenly spaced around tweeter alignment base 126*a*. According to some embodiments, each tweeter alignment protrusion 126*b* includes a threaded aperture (not numbered) configured to receive a threaded fastener, such as a bolt (shown by not numbered in FIGS. 11*a*-11*b*), the threaded aperture further extends through alignment circumferential extension 126*c* in the vertical direction. According to some embodiments, alignment circumferential extension 126*c* further includes a recess around the upper portion of said threaded aperture, adapted to match geometrically matching features (not shown) of a tweeter horn 140, for alignment between tweeter alignment component 126 and tweeter horn 140.

Figure 12A:
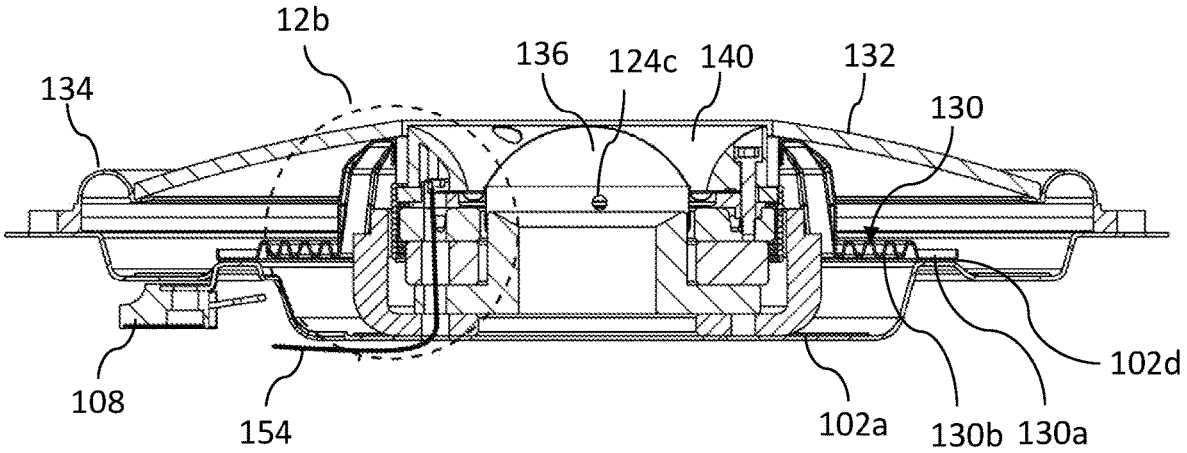
FIG. 12*a* constitutes a cross-sectional view of a speaker driver with a tweeter cable, according to some embodiments.
Figure 12B:
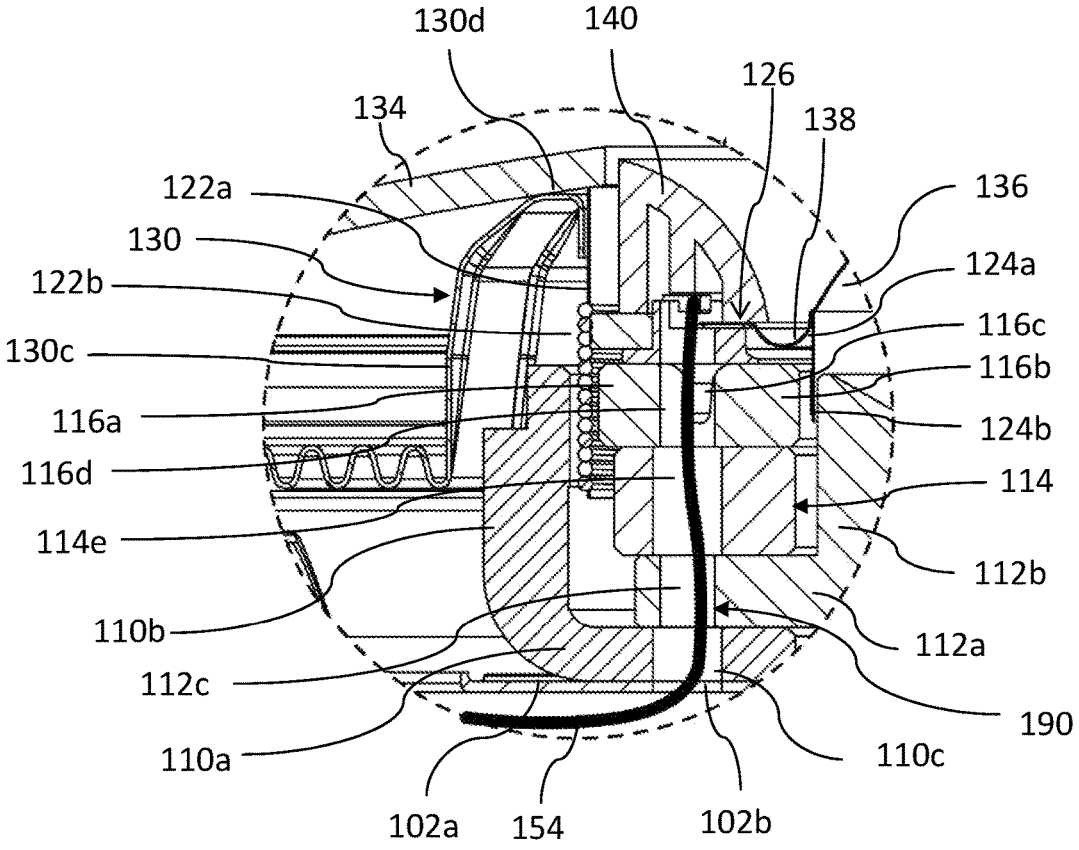
FIG. 12*b* constitutes an enlarged view of region 12*b* marked in FIG. 12*a*, according to some embodiments.

According to some embodiments, tweeter alignment base 126*a* and alignment circumferential extension 126*c* include a tweeter cable aperture 126*d*, adapted to receive a tweeter cable 154 (indicated in FIGS. 12*a*-12*b*). According to some embodiments, tweeter cable 154 includes at least two tweeter electric wires (not shown), branched out from tweeter cable 154 to at least one tweeter wire fastener 126*f*, seated on the upper edge of alignment circumferential extension 126*c*, further extending towards tweeter voice coil 124 through at least one tweeter wire opening 126*e* passing through tweeter alignment base 126*a*.

While an embodiment of tweeter alignment component 126 is illustrated in FIGS. 9*a*-9*d* with three tubular alignment circumferential extensions 126*c*, it will be understood by those of skill in the art that the number of alignment circumferential extensions 126*c* vary to any other amount, at any location along tweeter alignment base 126*a*, and having any other geometrical shape, such as rectangular or triangular protrusions.

Figure 10A:
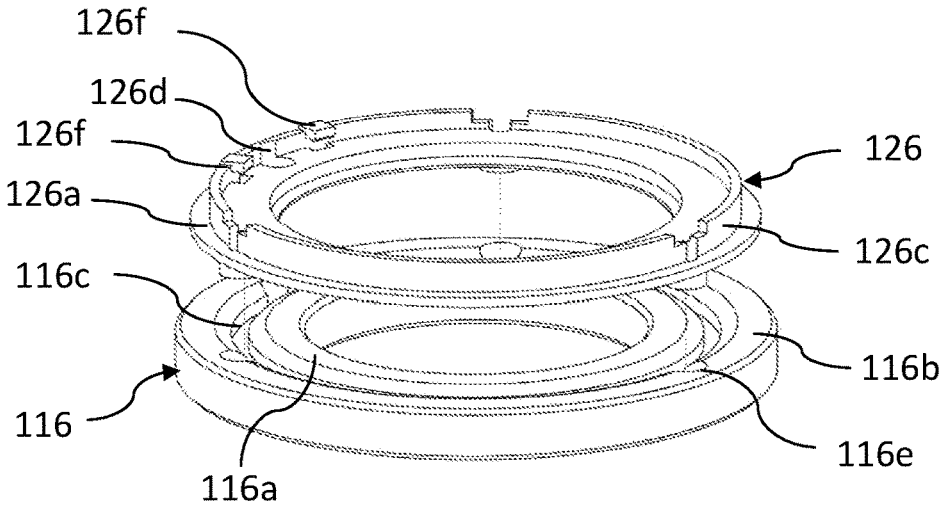
FIG. 10*a* constitutes an exploded view in perspective of a tweeter alignment component and a top plate, according to some embodiments.
Figure 10B:
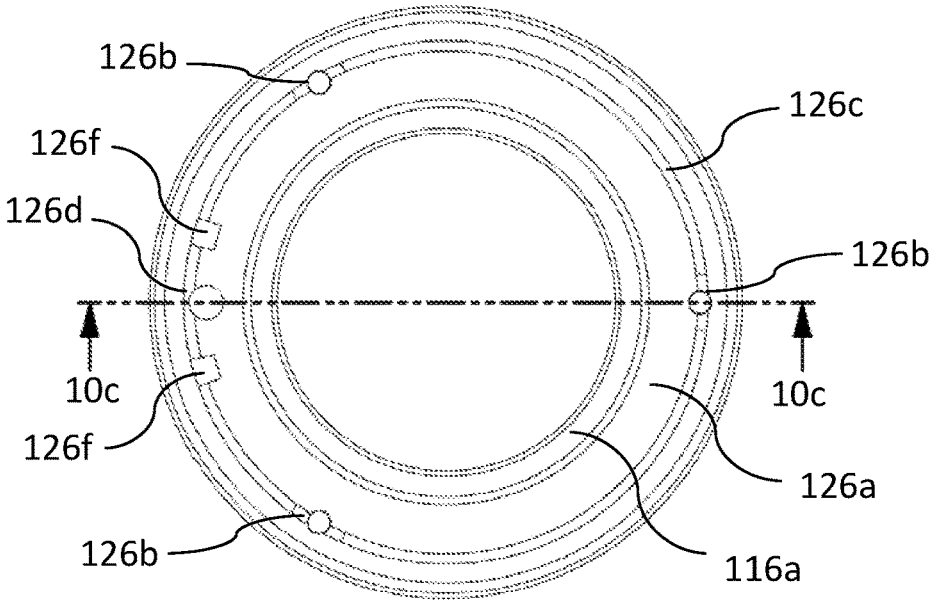
FIG. 10*b* constitutes a top-view of a tweeter alignment component and a top plate subassembly, according to some embodiments.
Figure 10C:
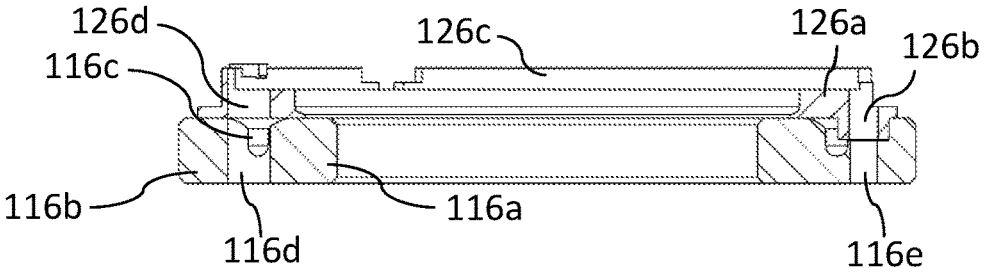
FIG. 10*c* constitutes a cross-sectional view of a tweeter alignment component and a top plate subassembly taken on line 10*c*-10*c* of FIG. 10*b*, according to some embodiments.

Reference is now made to FIGS. 10*a*-10*c*. FIGS. 10*a* and 10*b* constitute an exploded view in perspective and a top view, respectively, of tweeter alignment component 126 and top plate 116 subassembly, according to some embodiments. FIG. 10*c* constitutes a cross-sectional view of the tweeter alignment component 126 and top plate 116 subassembly taken on line 10*c*-10*c* of FIG. 10*b*. Top plate 116 includes at least one plate recess 116*e*, configured to receive the at least one tweeter alignment protrusion 126*b*. According to some embodiments, the number of plate recesses 116*e* is identical to the number of tweeter alignment protrusion 126*b*, and tweeter alignment component 126 is placed on top plate 116 such that each one tweeter alignment protrusion 126*b* is aligned with and inserted into a matching plate recess 116*e*.

According to some embodiments, each plate recess 116*e* includes a plate threaded aperture (not numbered). Whenever each tweeter alignment protrusion 126*b* is aligned with and inserted into plate recess 116*e*, a continuous threaded opening is formed between tweeter alignment protrusion 126*b* and plate recess 116*e*. The continuous threaded opening is configured to receive a threaded fastener, such as a bolt (shown by not numbered in FIGS. 11*a*-11*b*). According to some embodiments, top plate 116 further includes plate cable aperture 116*d*, so that when tweeter alignment component 126 is placed and aligned on top of top plate 116, tweeter cable aperture 126*d* is aligned with plate cable aperture 116*d* to form a continuous duct through which tweeter cable 154 can pass.

According to some embodiments, tweeter alignment protrusion 126*b* is formed as a continuous circular protrusion (not shown), following the entire circumference of tweeter alignment base 126*a*. The continuous circular protrusion is configured in its dimensions and shape so that when tweeter base 126 is placed on top of top plate 116, tweeter alignment protrusion 126*b* is accepted within geometrical separating feature 116*c*, thereby providing alignment as to limit the movement of tweeter alignment component 126 relative to top plate 116 in the radial direction. According to some embodiments, the cross-section of tweeter alignment protrusion 126*b* is substantially identical to the cross section of geometrical separating feature 116*c*.

According to some embodiments, the cross-section of tweeter alignment protrusion 126*b* matches only a portion of geometrical separating feature 116*c*, such that upon placement of tweeter alignment component 126 on top of top plate 116, the radial movement of the former is limited in the radial direction relative to the later. According to some embodiments, tweeter alignment component 126 is not provided with tweeter alignment protrusion 126*b*. According some embodiments, top plate 116 is provided with at least one ridge (not shown), and tweeter alignment component 126 is provided with at least one recess (not shown), such that the at least one recess is configured to match in its geometrical dimensions and shape the at least one ridge, thereby providing alignment between tweeter alignment component 126 and top plate 116 when the former is seated on the later.

Figure 11A:
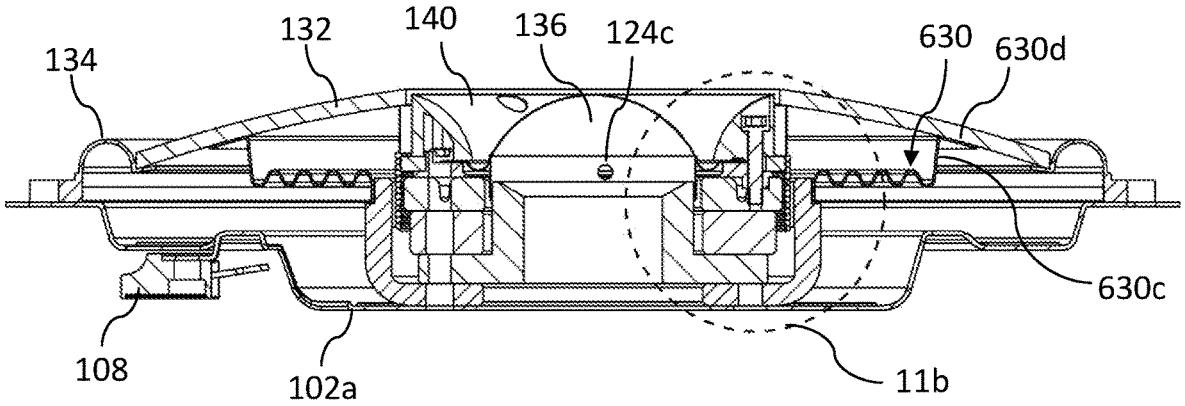
FIG. 11*a* constitutes a cross-sectional view of a speaker driver, according to some embodiments.
Figure 11B:
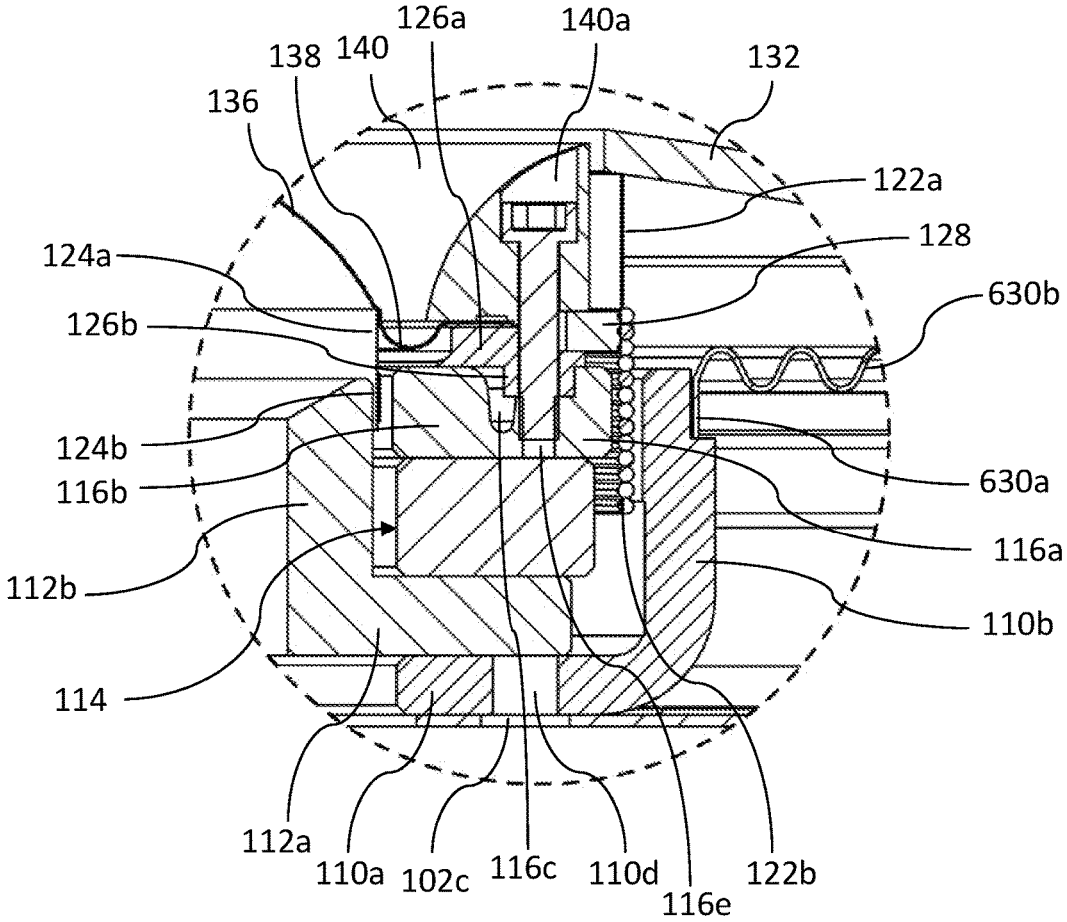
FIG. 11*b* constitutes an enlarged view of region 11*b* marked in FIG. 11*a*, according to some embodiments.

Reference is now made to FIGS. 11*a*-11*b*. FIG. 11*a* constitutes a cross-sectional view of speaker driver 100 with spider 630, according to some embodiments. FIG. 11*b* constitutes an enlarged view of region 11*b* marked in FIG. 11*a*. Spider neck portion 630*d* is attached to woofer diaphragm 132, while spider outer circumferential portion 630*a* is attached to cup sidewall 110*b*. According to some embodiments, cup sidewall 110*b* includes a cup recess (not numbered) in its upper portion, configured to receive spider outer circumferential portion 630*a*.

Tweeter surround 138 connects between tweeter diaphragm 136 and tweeter alignment base 126*a*. Tweeter horn 140 is mounted on top of tweeter alignment base 126*a*, surrounding tweeter diaphragm 136. Tweeter horn 140 includes at least one tweeter horn opening 140*a*, substantially similar in its diameter to the aperture of the at least one tweeter alignment protrusions 126*b*, so that upon placement of tweeter horn on top of tweeter alignment component 126, each tweeter horn opening 140*a* is aligned with a corresponding tweeter alignment protrusions 126*b*.

According to some embodiments, the at least one tweeter horn opening 140*a* is threaded. According to some embodiments, the number of tweeter horn openings 140*a* matches the number of tweeter alignment protrusions 126*b*. At least one bolt (not numbered) is threaded through an at least one continuous threaded duct formed by each tweeter horn opening 140*a*, situated upon the aperture of a corresponding tweeter alignment protrusions 126*b*, situated in turn on top of a corresponding plate recess 116*e*.

According to some embodiments, tweeter former 124*a* includes at least one voice coil opening 124*c*, configured to dissipate potential resonance that can build up during regular operation of speaker driver 100.

Tweeter alignment base 126*a* supports absorption ring 128, configured to absorb a portion of the pressure waves that can build up within the space of second gap 120 during regular operation of speaker driver 100. According to some embodiments, absorption ring 128 is a felt ring. According to some embodiments, absorption ring 128 is formed as a spiral rope (not shown), having the advantage of not only absorbing a portion of the pressure waves, but also creating small air turbulences in the vicinity of the threaded strands of said rope, thereby further dissipating air pressure buildup.

According to some embodiments, chassis base 102*a* includes at least one chassis attachment opening 102*c*, and cup base 110*a* is threaded with at least one cup thread aperture 110*d*, such that the at least one chassis attachment opening 102*c* is vertically aligned with the at least one cup thread aperture 110*d*, together forming at least one insertion through-hole for at least one fastening unit (not shown). The at least one fastening unit can be a screw, a bolt, a rivet and the like.

Reference is now made to FIGS. 12*a*-12*b*. FIG. 12*a* constitutes a cross-sectional view of speaker driver 100 with spider 130 and tweeter cable 154, according to some embodiments. FIG. 12*b* constitutes an enlarged view of region 12*b* marked in FIG. 12*a*. Spider outer circumferential portion 130*a* is attached to chassis first ledge 102*d*, which is elevated in comparison to chassis second ledge 102*e* in the vertical direction. According to some embodiments, said attachment is achieved by adhering horizontal spider outer circumferential portion 130*a* to chassis second ledge 102*e*.

Preferably, the vertical height of chassis second ledge is configured to allow vertical displacement of woofer diaphragm 132. Preferably, the vertical height of chassis first ledge 102*d* is configured to match between the vertical length of spider rising portion 130*d* and the vertical space length of first gap 118, through which woofer voice coil 122 is allowed to displace in the vertical direction.

Spider neck portion 130*d* is formed, according to some embodiments, with at least three sections (not numbered). A vertical section in its radial innermost edge, configured for attachment to woofer former 122*a*. A horizontal section perpendicular to the vertical section, extending radially outwards therefrom, configured for attachment to woofer diaphragm 134. Finally, an angled section extending from the horizontal section to spider rising portion 130*c*, forming an obtuse angle between said horizontal section and said angled section. Advantageously, attaching spider 130 to all three components: chassis 102, woofer diaphragm 134 and woofer voice coil 122 improves stability and movement control of both woofer diaphragm 134 and woofer voice coil 122.

According to some embodiments, chassis base 102*a*, cup base 110*a*, bottom yoke 112*a*, magnet 114, top plate 116 and tweeter alignment component 126 are provided with chassis cable aperture 102*b*, cup cable aperture 110*c*, yoke cable aperture 112*c*, magnet cable aperture 114*e*, plate cable aperture 116*d* and tweeter cable aperture 126*d*, respectively. According to some embodiments, chassis cable aperture 102*b*, cup cable aperture 110*c*, yoke cable aperture 112*c*, magnet cable aperture 114*e*, plate cable aperture 116*d* and tweeter cable aperture 126*d* are aligned such that the center axis of each are vertically aligned, thereby forming a hollow passageway 190.

According to some embodiments, the diameter of each of chassis cable aperture 102*b*, cup cable aperture 110*c*, yoke cable aperture 112*c*, magnet cable aperture 114*e*, plate aperture 116*d* and tweeter cable aperture 126*d* is substantially identical, configured to allow passage of tweeter cable 154 there through. In some embodiments, the radial dimension of at least one of chassis cable aperture 102*b*, cup cable aperture 110*c*, yoke cable aperture 112*c*, magnet cable aperture 114*e*, plate aperture 116*d* and tweeter cable aperture 126*d* is different from at least one other aperture from the same group of cable apertures, such that the cable aperture with the smallest diameter is configured to allow passage of tweeter cable 154 there through.

Tweeter cable 154, according to some embodiments, includes at least two electric wires (not shown). Tweeter cable 154 passes through hollow passageway 190 until it protrudes upwards from tweeter cable aperture 126*d* (see FIGS. 9*a*-9*b*). At that point tweeter cable 154 can split to the at least two electric wires, each wire being held in place by a tweeter wire fastener 126*f*, the wire then passes through a tweeter wire opening 126*e*, to be finally attached at its tip to tweeter voice coil wire 124*b*.

Figure 13:
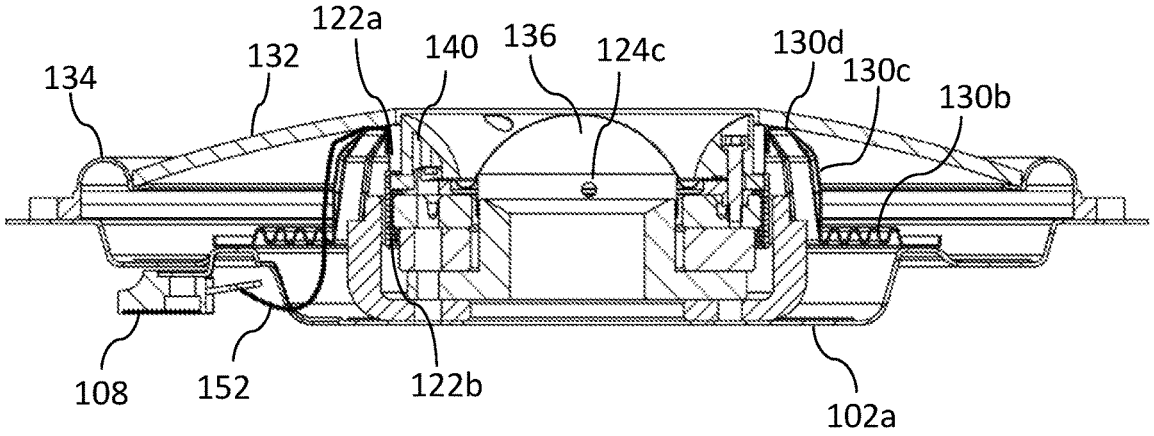
FIG. 13 constitutes a cross-sectional view of a speaker driver with a woofer cable, according to some embodiments.

Reference is now made to FIG. 13. FIG. 13 constitutes a cross-sectional view of speaker driver 100 with spider 130 and a woofer cable 152, according to some embodiments. Woofer cable 152, according to some embodiments, includes at least two electric wires (not shown). Woofer cable 152 originates from woofer terminal 108, passing through a woofer cable opening in chassis 102 (not shown), following the contours of at least a portion of spider rising portion 130*b* and at least a portion of spider neck portion 130*c*, towards woofer voice coil 122, where each of the electric wires of woofer cable 152 connects with woofer voice coil wire 122*b*.

Figure 14A:
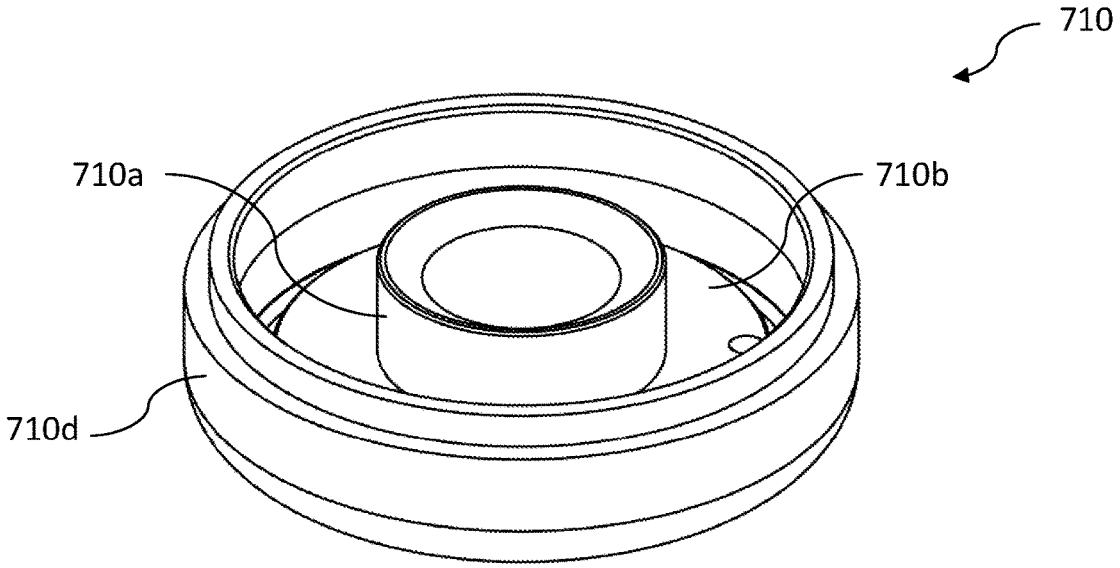
FIG. 14*a* constitutes a view in perspective of a cup yoke, according to some embodiments.
Figure 14B:
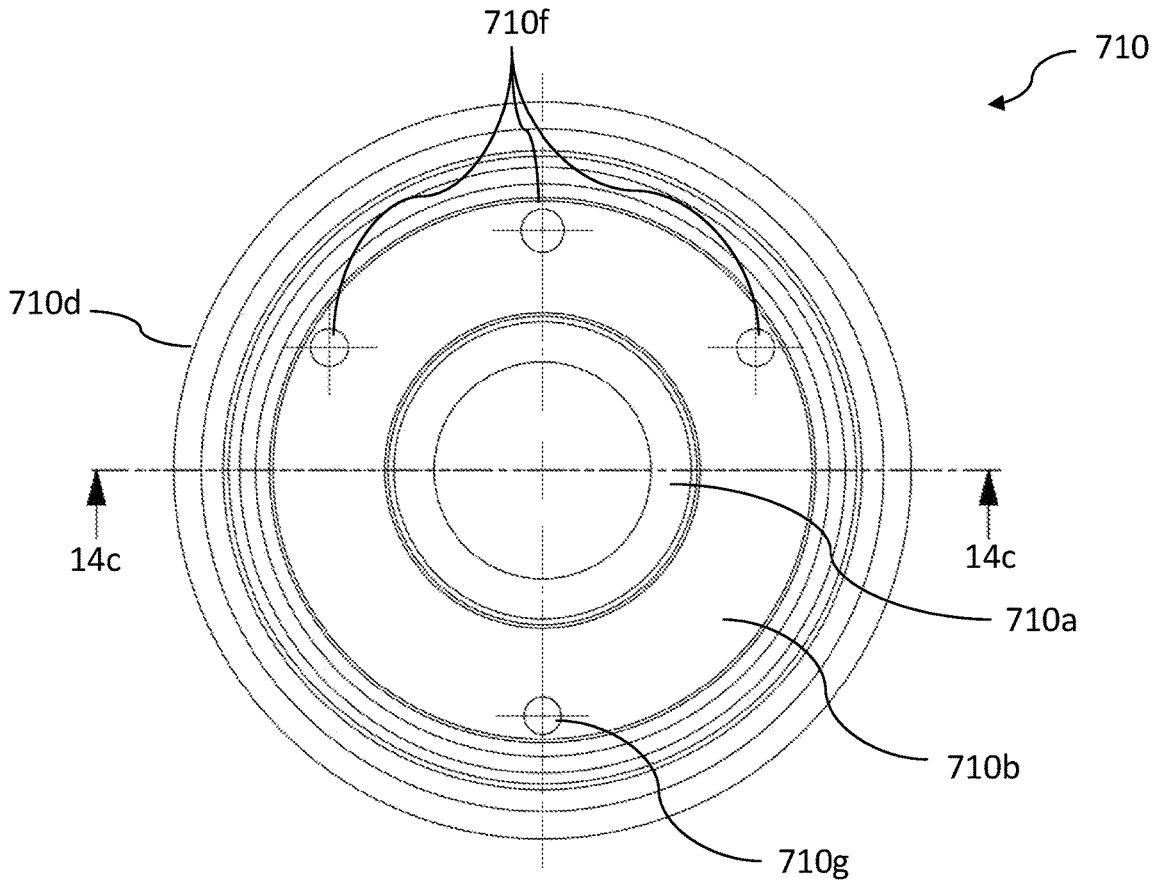
FIG. 14*b* constitutes a top-view of a cup yoke, according to some embodiments.
Figure 14C:
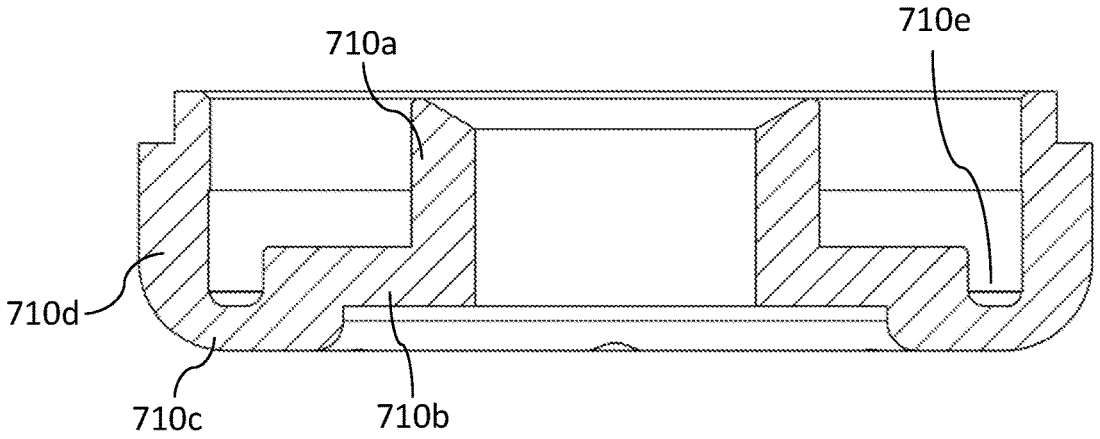
FIG. 14*c* constitutes a cross-sectional view of a cup yoke taken on line 14*c*-14*c* of FIG. 14*b*, according to some embodiments.

Reference is now made to FIGS. 14*a*-14*c*. FIGS. 14*a* and 14*b* constitute a view in perspective and a top-view, respectively, of a cup yoke 710, according to some embodiments. FIG. 14*c* constitutes a cross-sectional view of cup yoke 710 taken on line 14*c*-14*c* of FIG. 14*b*. Cup yoke 710 is an embodiment of a single component which replaces both cup 110 and T-yoke 112. Cup yoke 710 comprises a center pole 710*a*, a first yoke base portion 710*b*, a second yoke base portion 710*c* and a yoke sidewall 710*d*. According to some embodiments, the upper surface (not numbered) of first yoke base portion is vertically lower than the upper surface (not numbered) of the second yoke base portion, thereby forming yoke depression 710*e*, configured to allow movement of woofer voice coil 122 in the vertical direction.

According to some embodiments, yoke second base portion 710*c* includes at least one yoke cup thread aperture 710*f*, configured for vertical alignment with the at least one chassis attachment opening 102*c*, together forming at least one insertion through-hole for at least one fastening unit (not shown). The at least one fastening unit can be a screw, a bolt, a rivet and the like.

While an embodiment of cup yoke 710 is illustrated in FIG. 14*b* with three yoke cup thread apertures 710*f*, it will be understood by those of skill in the art that the number yoke cup thread apertures 710*f* vary to any other amount, at any location along either first yoke base portion 710*b* or second yoke base portion 710*c*.

According to some embodiments, cup yoke 710 includes a cup yoke cable aperture 710*g*, configured to replace both cup cable aperture 110*c* and yoke cable aperture 112*c* to form hollow passageway 190 in the same manner described hereinabove.

According to some embodiments, cup yoke 710 includes a geometrical separating feature (not shown), similar to geometrical separating feature 312*c* shown in FIG. 5*c*, located either in first yoke base portion 710*b*, second yoke base portion 710*c*, or both.

It is appreciated that certain features of the invention, which are, for clarity, described in the context of separate embodiments, may also be provided in combination in a single embodiment. Conversely, various features of the invention, which are, for brevity, described in the context of a single embodiment, may also be provided separately or in any suitable sub-combination or as suitable in any other described embodiment of the invention. No feature described in the context of an embodiment is to be considered an essential feature of that embodiment, unless explicitly specified as such.

Although the invention is described in conjunction with specific embodiments thereof, it is evident that numerous alternatives, modifications and variations that are apparent to those skilled in the art may exist. It is to be understood that the invention is not necessarily limited in its application to the details of construction and the arrangement of the components and/or methods set forth herein. Other embodiments may be practiced, and an embodiment may be carried out in various ways. Accordingly, the invention embraces all such alternatives, modifications and variations that fall within the scope of the appended claims.

The invention claimed is:

1. A speaker driver comprising:

a magnet having a magnet top portion, a magnet bottom portion, a magnet outer circumference and a magnet inner circumference;

a woofer voice coil disposed around the magnet outer circumference;

a tweeter voice coil disposed around the magnet inner circumference; and a top plate adjacent on a horizontal plane to the magnet;

the top plate having a first plate portion and a second plate portion, separated by a geometrical separating feature, wherein the magnet is configured to generate a first magnetic flux passing through the first plate portion and the woofer voice coil and a second magnetic flux passing through the second plate portion and the tweeter voice coil; and wherein the location of the geometrical separating feature along the top plate is configured to influence the intensity of each of the first magnetic flux and the second magnetic flux.

2. The speaker driver of claim 1, wherein the woofer voice coil comprises a woofer former and a woofer voice coil wire wound around the woofer former; wherein the tweeter voice coil comprises a tweeter former and a tweeter voice coil wire wound around the tweeter former; and wherein the middle point along the vertical length of the woofer voice coil wire and the middle point along the vertical length of the tweeter voice coil wire are substantially in the same horizontal plane.

3. The speaker driver of claim 1, wherein the separating geometrical feature is a circumferential recess.

4. The speaker driver of claim 1, wherein the separating geometrical feature is located radially at the center of the top plate.

5. The speaker driver of claim 1, wherein the geometrical separating feature is located radially closer to the magnet inner circumference than to the magnet outer circumference.

6. The speaker driver of claim 1, wherein the magnet comprises neodymium.

7. The speaker driver of claim 1, wherein the geometrical separating feature is protruding throughout the complete vertical height of the top plate, thereby spacing apart the first plate portion and the second plate portion.

8. The speaker driver of claim 1, further comprising:

a woofer diaphragm with a woofer surround, connected to a chassis having a chassis rim; and a tweeter diaphragm with a tweeter surround, connected to a tweeter alignment component placed on top of the top plate, wherein the woofer former is attached to the woofer diaphragm, and the tweeter former is attached to the tweeter diaphragm;

wherein the top plate comprises at least one plate recess; and wherein the tweeter alignment component further comprises at least one alignment protrusion, configured to be accepted within the at least one plate recess, thereby aligning the tweeter alignment component and the top plate.

9. The speaker driver of claim 8, further comprising a spider.

10. The speaker driver of claim 9, wherein the spider comprises a spider corrugation portion having spider outer circumferential portion;

a spider rising portion;

a spider neck portion; and at least one reinforcement rib, extending from at least a portion of the spider rising portion to at least a portion of the spider neck portion, wherein the spider corrugation portion, the spider rising portion and the spider neck portion are formed as a single composite piece, and wherein the spider is attached to the chassis via the spider outer circumferential portion, and to the woofer voice coil and the woofer diaphragm via the spider neck portion.

11. The speaker driver of claim 1, further comprising:

a chassis having a chassis base;

a cup having a cup base and a cup sidewall, wherein the cup base is disposed on the chassis base and the woofer voice coil is disposed within a first gap, formed between the cup sidewall and the magnet outer circumference; and a yoke having a bottom yoke and a center pole, wherein the bottom yoke is disposed on the cup base and the tweeter voice coil is disposed within a second gap, formed between the center pole and the magnet inner circumference, wherein the first magnetic flux runs from the magnet to the first plate portion, the first gap passing through the woofer voice coil, the cup sidewall, the cup base, the yoke bottom and back to the magnet; and wherein the second magnetic flux runs from the magnet to the second plate portion, the second gap passing through the tweeter voice coil, the central pole, the bottom yoke and back to the magnet.

12. The speaker driver of claim 11, wherein the bottom yoke further comprises a yoke geometrical separating feature.

13. The speaker driver of claim 11, wherein the cup comprises a cup cable aperture, the yoke comprises a yoke cable aperture, the magnet comprises a magnet cable aperture, the top plate comprises a top plate cable aperture and the tweeter alignment component comprises a tweeter cable aperture; and wherein the cup cable aperture, the yoke cable aperture, the magnet cable aperture, the top plate cable aperture and the tweeter cable aperture are vertically aligned.

14. The speaker driver of claim 1, further comprising:

a chassis having a chassis base; and a cup yoke having a center pole, a first yoke base portion having an upper surface, a second yoke base portion having an upper surface, and a cup yoke sidewall, wherein the upper surface of the first yoke base portion is vertically lower than the upper surface of the second yoke base portion, wherein the second yoke base portion is disposed on the chassis base, wherein the woofer voice coil is disposed within a first gap formed between the cup yoke sidewall and the magnet outer circumference, and wherein the tweeter voice coil is disposed within a second gap formed between the center pole and the magnet inner circumference, wherein the first magnetic flux runs from the magnet to the first plate portion, the first gap passing through the woofer voice coil, the cup yoke sidewall, the second yoke base, the first yoke base and back to the magnet; and wherein the second magnetic flux runs from the magnet to the second plate portion, the second gap passing through the tweeter voice coil, the central pole, the first yoke base and back to the magnet.

15. The speaker driver of claim 14, wherein the second yoke base portion further comprises a yoke geometrical separating feature.

16. The speaker driver of claim 14, wherein the cup yoke comprises a cup yoke cable aperture, the magnet comprises a magnet cable aperture, the top plate comprises a top plate cable aperture and the tweeter alignment component comprises a tweeter cable aperture; and wherein the cup cable aperture, the yoke cable aperture, the magnet cable aperture, the top plate cable aperture and the tweeter cable aperture are vertically aligned.

* * * * *